US012654069B2

(12) United States Patent
DaCosta et al.

(10) Patent No.: US 12,654,069 B2
(45) Date of Patent: Jun. 16, 2026

(54) DIMPLE PATTERNS FOR GOLF BALLS

(71) Applicant: Acushnet Company, Fairhaven, MA (US)

(72) Inventors: Emilia DaCosta, New Bedford, MA (US); Courtney N. Engle, Fall River, MA (US); Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 131 days.

(21) Appl. No.: 18/502,364

(22) Filed: Nov. 6, 2023

(65) Prior Publication Data

US 2024/0066358 A1 Feb. 29, 2024

Related U.S. Application Data

(63) Continuation-in-part of application No. 17/188,541, filed on Mar. 1, 2021, now abandoned, which is a continuation-in-part of application No. 16/558,131, filed on Sep. 1, 2019, now Pat. No. 10,933,283, which is a continuation-in-part of application No. 16/035,816, filed on Jul. 16, 2018, now Pat. No. 10,398,941, which is a continuation of application No. 15/431,838, filed on Feb. 14, 2017, now Pat. No. 10,022,592, which is a continuation of application No. 14/144,483, filed on Dec. 30, 2013, now Pat. No. 9,566,473.

(51) Int. Cl.
*A63B 37/00* (2006.01)

(52) U.S. Cl.
CPC .... *A63B 37/00065* (2020.08); *A63B 37/0006* (2013.01)

(58) Field of Classification Search
CPC ..... A63B 37/0012; A63B 37/0004; A63B 37/00065; A63B 37/0018; A63B 37/002; A63B 37/0021; A63B 37/0022; A63B 37/0006
See application file for complete search history.

(56) References Cited

U.S. PATENT DOCUMENTS 5,016,887 A * 5/1991 Jonkouski ..... A63B 37/0004 473/379
5,060,954 A * 10/1991 Gobush ..... A63B 37/0004 473/379

(Continued)

*Primary Examiner* — John E Simms, Jr.
(74) *Attorney, Agent, or Firm* — Steven Landolfi, Jr.

(57) ABSTRACT

A golf ball has a first hemisphere and a second hemisphere and a plurality of dimples arranged in a pattern divided into dimple segments separated by n longitudinal lines. Within each hemisphere, the plurality of dimples consists of shared dimples that are intersected by the longitudinal lines and segment dimples that are each wholly within one of the n number of dimple segments. The arrangement of the shared dimples on each of the longitudinal lines is identical. The n number of dimple segments comprise at least two segments, S1 and S2, in each hemisphere that have a different longitudinal angle from each other. The S1 segment has a first value for a segment parameter and the S2 segment has a second value for the segment parameter. The first value is different than the second value.

14 Claims, 24 Drawing Sheets

(56) References Cited

U.S. PATENT DOCUMENTS

| | | | | |
|---|---|---|---|---|
| 5,890,974 | A * | 4/1999 | Stiefel | A63B 37/0004 473/384 |
| 2002/0165043 | A1* | 11/2002 | Winfield | A63B 37/0004 473/378 |
| 2007/0049423 | A1* | 3/2007 | Nardacci | A63B 37/0021 473/378 |
| 2013/0090189 | A1* | 4/2013 | Felker | A63B 37/0064 473/383 |
| 2015/0182802 | A1* | 7/2015 | Madson | A63B 37/00065 473/378 |
| 2016/0067552 | A1* | 3/2016 | Hixenbaugh | A63B 37/0021 473/383 |
| 2019/0381363 | A1* | 12/2019 | Madson | A63B 1/00 |
| 2021/0052948 | A1* | 2/2021 | Madson | A63B 37/0006 |
| 2021/0138305 | A1* | 5/2021 | Engle | A63B 37/002 |
| 2022/0072385 | A1* | 3/2022 | Engle | A63B 37/0007 |
| 2022/0105392 | A1* | 4/2022 | Engle | A63B 37/0012 |

* cited by examiner

DIMPLE PATTERNS FOR GOLF BALLS

CROSS REFERENCE TO RELATED APPLICATIONS

The present application is a continuation-in-part of U.S. patent application Ser. No. 17/188,541, filed Mar. 1, 2021, which is a continuation-in-part of U.S. patent application Ser. No. 16/558,131, filed Sep. 1, 2019, now U.S. Pat. No. 10,933,283, which is a continuation-in-part of U.S. patent application Ser. No. 16/035,816, filed. Jul. 16, 2018, now U.S. Pat. No. 10,398,941, which is a continuation of U.S. patent application Ser. No. 15/431,838, filed Feb. 14, 2017, now U.S. Pat. No. 10,022,592, which is a continuation of U.S. patent application Ser. No. 14/144,483, filed Dec. 30, 2013, now U.S. Pat. No. 9,566,473, the entire disclosures of which are hereby incorporated herein by reference.

FIELD OF THE INVENTION

This invention relates to golf halls having two hemispheres, each hemisphere having a dimple pattern based on a pyramid having dissimilar sides.

BACKGROUND OF THE INVENTION

U.S. Patent Application Publication No. 2013/0072325 to Madson et al. discloses a golf ball dimple pattern having an underlying geometry based on a dipyramid.

U.S. Pat. No. 7,503,856 to Nardacci et al. discloses a golf ball dimple pattern based on a hexagonal dipyramid, wherein the dimples are arranged in six substantially similar mating dimple sections on each hemisphere.

U.S. Patent Application Publication No. 2012/0004053 to Kim discloses a designing method for a dimple pattern of a golf ball including the steps of (1) dividing a surface of a phantom sphere of the golf ball into a plurality of units by division lines obtained by projecting edge lines of a regular polyhedron inscribed in the phantom sphere, on the surface of the phantom sphere; (2) obtaining a base pattern by randomly arranging a plurality of dimples in one unit such that the dimples do not overlap each other; and (3) developing the base pattern over other units such that patterns of two adjacent units are not mirror-symmetrical to each other.

SUMMARY OF THE INVENTION

According to some embodiments, the present disclosure describes a golf ball including a first hemisphere and a second hemisphere separated by an equator, each hemisphere including on the outer surface thereof a plurality of dimples arranged in a pattern, wherein the pattern is defined by an n-sided pyramid projected on a hemisphere and the side edges of the pyramid representing n longitudinal lines from pole to equator, wherein n≥3. The pattern includes n number of dimple segments between the longitudinal lines, wherein a longitudinal angle between the side edges represents a size of each dimple segment. Within each hemisphere, the plurality of dimples consists of shared dimples that are intersected by the n longitudinal lines, and segment dimples that are each wholly within one of the n number of dimple segments. The arrangement of the shared dimples on each of the longitudinal lines is identical. The n number of dimple segments comprise at least two segments, S1 and S2, in each hemisphere that have a different longitudinal angle from each other. The S1 segment has a first value for a segment parameter, wherein the first value is the same for a majority of the segment dimples in the S1 segment. The S2 segment has a second value for the segment parameter, wherein the second value is the same for a majority of the segment dimples in the S2 segment. The first value is different than the second value.

According to some other embodiments, the present disclosure describes another golf ball having a first hemisphere and a second hemisphere separated by an equator, each hemisphere including on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3. The pattern includes n number of dimple segments between the longitudinal lines, wherein a longitudinal angle between the side edges represents a size of each dimple segment. Within each hemisphere, the plurality of dimples consists of shared dimples that are intersected by the n longitudinal lines, and segment dimples that are each wholly within one of the n number of dimple segments. The arrangement of the shared dimples on each of the longitudinal lines is identical. The n number of dimple segments comprise at least two of the segments, S1 and S2, in each hemisphere that have a different longitudinal angle. The S1 segment has a first value for a first segment parameter and a second value for a second segment parameter, wherein the first value is the same for the majority of the segment dimples in the S1 segment, and wherein the second value is the same for the majority of the segment dimples in the S1 segment. The S2 segment has a third value for the first segment parameter and a fourth value for the second segment parameter, wherein the third value is the same for the majority of the segment dimples in the S2 segment, and wherein the fourth value is the same for the majority of the segment dimples in the S2 segment. The first value is different than the third value for the first segment parameter. The second value is the same as the fourth value for the second segment parameter.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
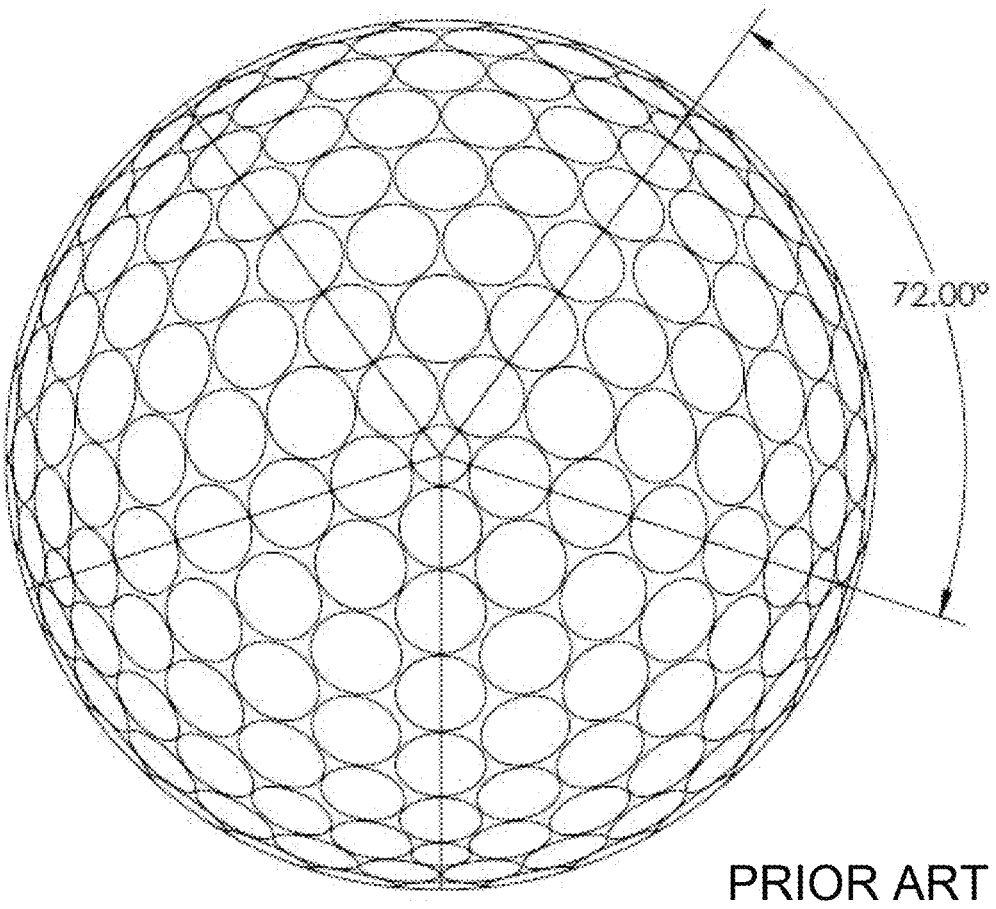
FIG. 1 is a polar view of a golf having a dimple pattern arranged according to a method known in the art.

Golf balls of the present invention include a first pole, a second pole opposite the first pole, and an equator evenly spaced between the first and second poles so as to divide the golf ball into a first hemisphere including the first pole and a second hemisphere including the second pole. The outer surface of each hemisphere includes a plurality of dimples arranged in a pattern.

In disclosed embodiments, the dimple pattern formed on the surface of a golf ball is defined by an n-sided pyramid projected on a hemisphere as n lines of longitude from pole to equator, wherein $n \geq 3$. In a particular embodiment, $n \geq 4$ for one or both of the hemispheres. At least two of the sides of the pyramid are dissimilar. For purposes of the present invention, one side of the pyramid is dissimilar to another side of the pyramid if they have a different longitudinal angle, $\phi_i$, and a different arrangement of dimples. When combined, the longitudinal angles of each hemisphere sum to 360. For a hemisphere having m dissimilar sides, and $r_i$ repetitions of each side:

$$\Sigma_{i=1}^{m} r_i \phi_i = 360. \quad \text{(Equation 1)}$$

The total number of distinct hemispheres that can be created, $\tau$, is calculated as the number of circular permutations:

$$\tau = \frac{(n-1)!}{r_1! \times r_2! \times \ldots \times r_m!}, \quad \text{(Equation 2)}$$

where n, the total number of sides for a hemisphere, is:

$$n = \Sigma_{i=1}^{m} r_i. \quad \text{(Equation 3)}$$

In a particular embodiment, the first hemisphere and the second hemisphere have the same number of sides. In a particular aspect of this embodiment, the dimple arrangement of the first hemisphere and the dimple arrangement of the second hemisphere are the same. In another particular aspect of this embodiment, the dimple arrangement of the first hemisphere and the dimple arrangement of the second hemisphere are different.

In another particular embodiment, the first hemisphere and the second hemisphere have a different number of sides.

Each dimple is either located entirely within a single side of the pyramid or is intersected by a side edge of the pyramid such that the center of the dimple lies on the same plane as the side edge, i.e., a longitudinal line. The longitudinal lines described herein are understood to be phantom longitudinal lines, as they represent the projection of a pyramid to arranged the dimples but are not present as lines on the surface of the golf ball. In a particular embodiment, the dimple arrangement along each longitudinal line of a hemisphere is identical, meaning that each dimple that is located along a side edge of the pyramid is replicated on all side edges of the pyramid. For purposes of the present invention, a dimple on one edge is a replicate of a dimple on another edge if the dimples have the same latitudinal angle and diameter. By way of definition, if such a dimple arrangement is repeated on multiple longitudinal lines, then those lines define the edges of the segments. If more than one such a dimple arrangement exists then the segments edges are defined by the arrangement that produces the greatest number of segments on the ball. If more than one such a dimple arrangement exists and they produce the same number of segments, then any one arrangement can be used to define the edges of the segment, but not more than one.

In a particular embodiment, at least one side of a hemisphere, i.e., at least one dimple segment on the ball, has a dimple free area having a surface area of $\geq 0.06$ in$^2$. For purposes of the present disclosure, the term "dimple free area" refers to a dimple free area that has a surface area of $\geq 0.06$ in$^2$. All dimple patterns inherently have a certain amount of dimple free "fret area" between dimples. The portion of the golf ball surface that one of ordinary skill in the art would generally consider "fret area" is not meant to be included in calculating the surface area of the "dimple free area" of the present invention. Rather, for purposes of the present invention, a dimple free area having a surface area of $\geq 0.06$ in$^2$, is an area on the surface of the ball onto which a rectangle having that area can be projected without intersecting any dimples or including any dimples within its boundaries.

In a particular aspect of this embodiment, one hemisphere has at least one dimple segment with a dimple free area and the other hemisphere has no dimple segments with a dimple free area. In another particular aspect of this embodiment, one hemisphere has at least two dimple segments with a dimple free area and the other hemisphere has no dimple segments with a dimple free area. In another particular aspect of this embodiment, both hemispheres have at least one dimple segment with a dimple free area. In another particular aspect of this embodiment, one hemisphere has at least two dimple segments with a dimple free area and the other hemisphere has at least one dimple segment with a dimple free area. In another particular aspect of this embodiment, both hemispheres have two dimple segments with a dimple free area. In embodiments of the present invention wherein at least two dimple segments have a dimple free area, the dimple free area of one segment may be the same size or a different size than the dimple free area of another segment.

In some embodiments, the dimple free area(s) on the ball include a marking. Suitable markings include logos, and letters, numbers, and shapes that are part of a nameplate, side stamp, or logo. "Nameplate" typically, but not necessarily, refers to a marking corresponding to the golf ball brand. "Side stamp" typically, but not necessarily, refers to a marking corresponding to the model of the golf ball. In embodiments of the present invention wherein at least two dimple segments include a dimple free space with a marking, the marking of one dimple segment may be the same as or different from the marking of another dimple segment.

Each marking may be printed on the golf ball surface either underneath or on top of a coating layer, or engraved into the surface of the ball. For purposes of the present disclosure, "engraved" refers to the final appearance of the marking as being cut into, rather than printed on the surface of, the golf ball. Thus, engraved markings, for purposes of the present disclosure, includes markings that are cut directly into the golf ball using, for example, a machining or laser etching process, and markings that are formed by machining the marking into the master tool used to make dimpled cavities whereby the marking is transferred to the golf ball during the molding process.

Figure 2:
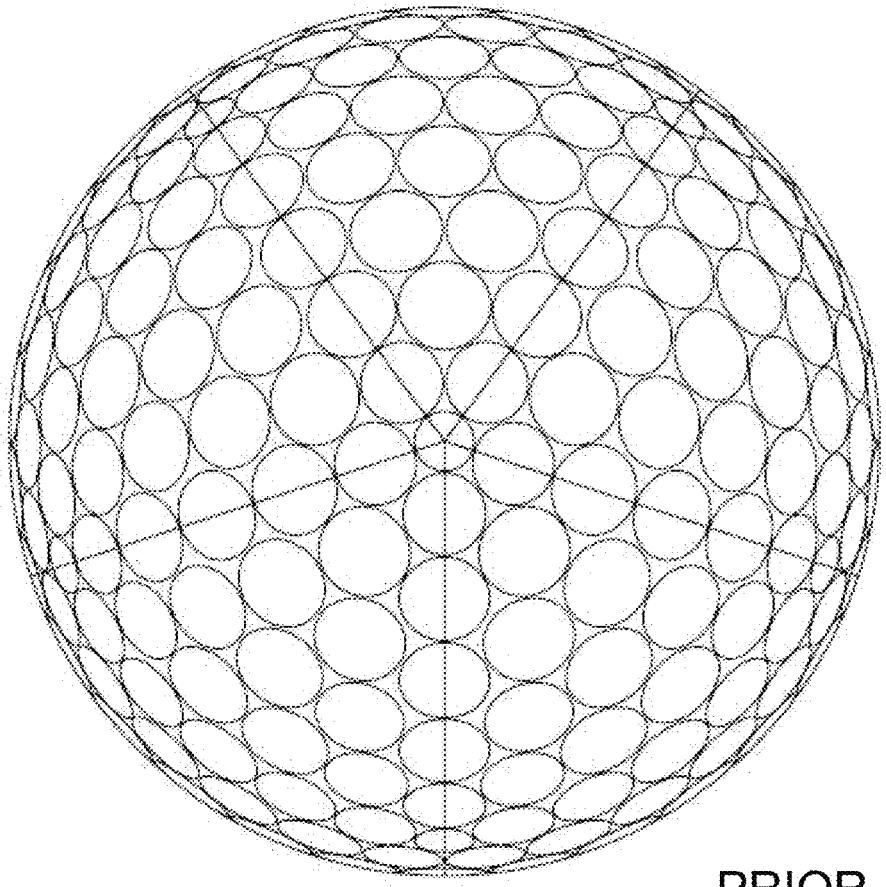
PRIOR ART FIG. 2
FIG. 2 is a polar view of the golf ball of FIG. 1 rotated 72° about the polar axis.

In a particular embodiment, the overall dimple pattern on each hemisphere does not have rotational symmetry about the polar axis. The polar axis is defined herein as the axis connecting the pole of the first hemisphere to the pole of the second hemisphere. Rotational symmetry is said to exist if a hemisphere can be rotated by any angle and result in an identical pattern, as with conventional golf ball dimple patterns. FIG. 1 is a polar view of a golf ball having a dimple pattern with rotational symmetry. When rotated 72° about the polar axis, the resulting pattern, shown in FIG. 2, is identical to the original pattern. A pattern is said to have x-fold rotational symmetry on a given hemisphere if any rotational angle $\gamma$ about the polar axis exists such that $$\frac{360}{\gamma} = x,$$

and x is a whole number ≥2. Thus, the pattern shown in FIGS. 1 and 2 has 5-fold rotational symmetry $$\left(\frac{360}{72} = 5\right).$$

Figure 3:
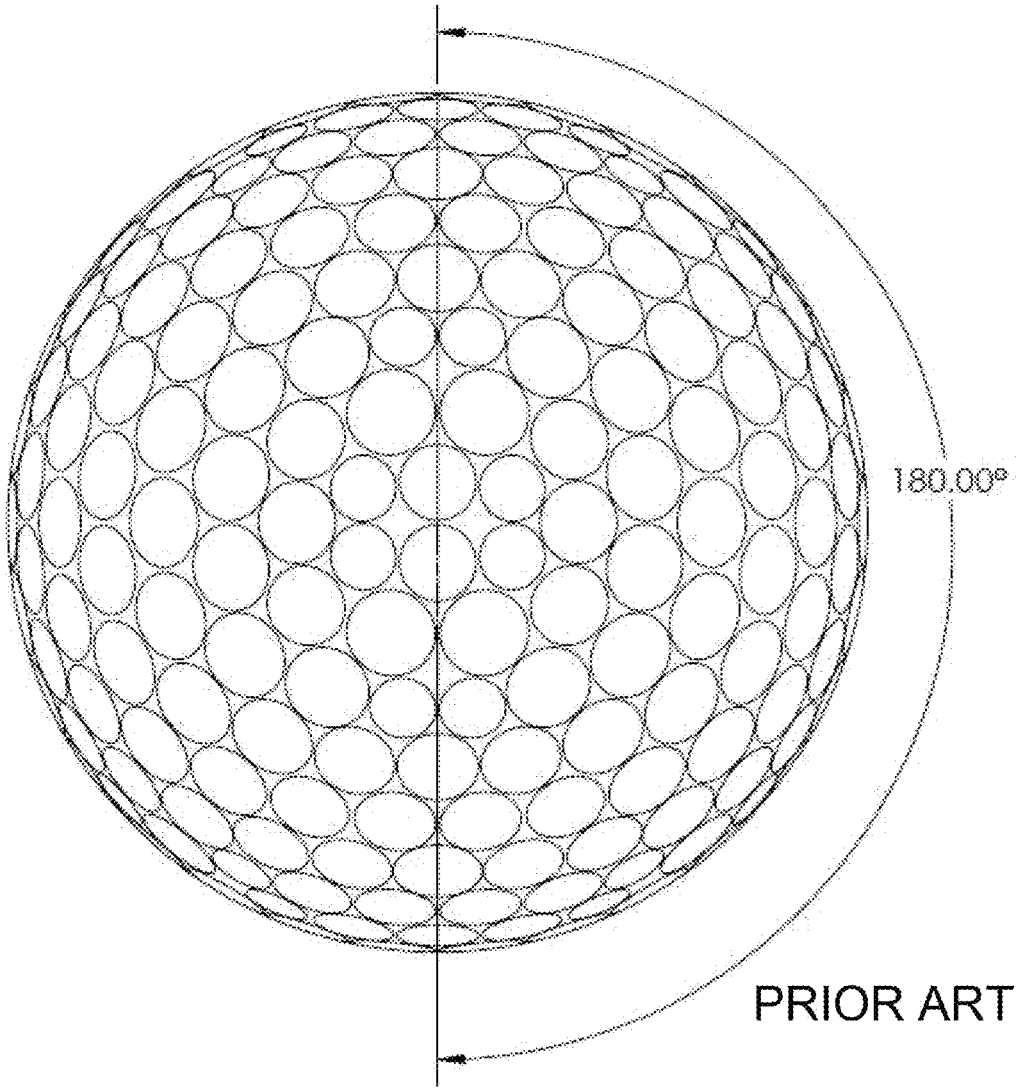
FIG. 3 is a polar view of a golf ball having a dimple pattern arranged according to a method known in the art.
Figure 4:
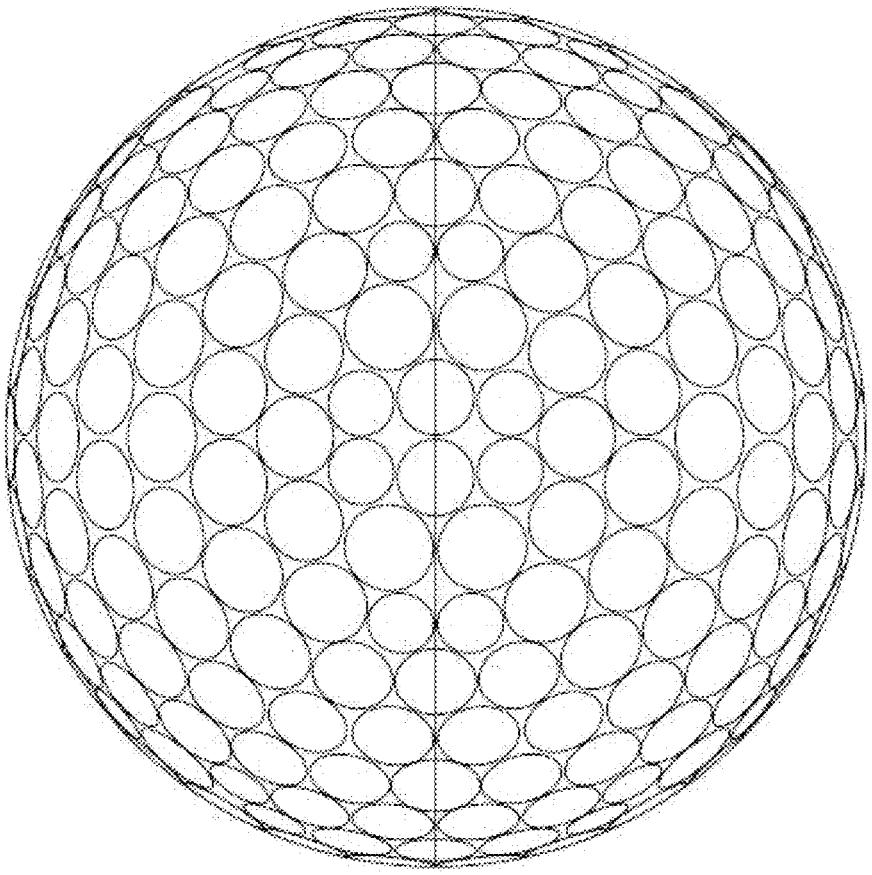
PRIOR ART FIG. 4
FIG. 4 is a polar view of the golf ball of FIG. 3 rotated 180° about the polar axis.

FIG. 3 is a polar view of another golf ball having a dimple pattern with rotational symmetry. When rotated 180° about the polar axis, the resulting pattern, shown in FIG. 4, is identical to the original pattern. Thus, the pattern shown in FIGS. 3 and 4 has 2-fold rotational symmetry $$\left(\frac{360}{180} = 2\right).$$

The two hemispheres can be positioned in any manner such that the dimples from one hemisphere do not intersect with dimples from the other hemisphere. In one embodiment, the two hemispheres are mirror images of each other and the ball has a flat, i.e., planar, parting line. In another embodiment, the two hemispheres have an angular rotation relative to one another and create a flat parting line. In another embodiment, the two hemispheres have an angular rotation relative to one another and create a staggered, i.e., non-planar, parting line, such that the dimples near the equator are allowed to cross over the ball equator but do not intersect dimples from the opposing hemisphere.

While preferably having a substantially circular plan shape, dimples of the present invention are not limited to a particular plan or cross-sectional shape.

Dimples of the present invention may have different properties including, but not limited to, cross-sectional shape, plan shape, dimple diameter, edge angle, chord depth, and dimple depth. In a particular embodiment, replicated dimples have the same cross-sectional shape and plan shape.

In another particular embodiment, a portion of the dimples are intersected by the equator, and all of the dimples that are intersected by the equator have the same dimple diameter. In a further aspect of this particular embodiment, the overall dimple pattern comprises three or more different dimple diameters, including a minimum dimple diameter, a maximum dimple diameter, and at least one additional dimple diameter, and the dimple diameter of the dimples that are intersected by the equator is not the minimum or maximum dimple diameter. In another further aspect of this particular embodiment, at least one of the dimples located along a side edge of the pyramid has the same dimple diameter as the dimples that are intersected by the equator; alternatively, none of the dimples located along the side edges of the pyramid has the same dimple diameter as the dimples that are intersected by the equator. In another further aspect of this particular embodiment, none of the dimples that are intersected by the equator is also located along a side edge of the pyramid.

Dimples of the present invention may have a variety of plan shapes, including, but not limited to, circular, polygonal, oval, or irregular shapes, and a variety of profile shapes, including, but not limited to, circular, catenary, elliptical, or conical shapes. There are various variables (also referred to herein as parameters) that define the dimple shape and profile, including variables that affect aerodynamic performance. For example, edge angle and chord depth are examples of dimple variables that contribute to the overall aerodynamic performance of a golf ball. Edge angle and chord depth relate generally to spherical dimples, but the same or similar parameters can also be determined for other shapes. For example, non-circular profile shapes may include an edge angle or effective edge angle and a chord depth or effective chord depth. These and other variables together define other dimple parameters, such as dimple volume (i.e., the amount of a material removed from a spherical ball to produce the dimple).

Further, the combined value of multiple dimples may be expressed as a golf ball parameter. For example, a golf ball has a total dimple volume. As used herein, total dimple volume is the total volume of material removed from a smooth ball to create the dimpled ball (the sum of all of the dimple volumes). Total dimple volume may be expressed as a percentage of the spherical ball that has been removed (e.g., generally in a range from 1-2%) or a total volume in $inches^3$. In some instances, total volume may be expressed per hemisphere, as "total hemisphere dimple volume." The total hemisphere dimple volume may be the total dimple volume per hemisphere of the golf ball. The total dimple volume is thus the sum of two total hemisphere dimple volumes.

Similarly, a dimple segment may have a dimple segment volume, which, as used herein, refers to the total volume of the dimples in a particular dimple segment. If there are n dimple segments for the entire golf ball (corresponding to an n-sided dipyramid, the sides of which may be either similar or dissimilar), the sum of the n dimple segment volumes is the total dimple volume for the golf ball. A similar calculation may be made per hemisphere when adding only the dimple segment volumes in a particular hemisphere of the golf ball. Dimples that fall on the longitudinal line sides edges of the dimple segments may count proportionally toward two dimple segment volumes.

In further embodiments, dimples that are located within a particular segment (corresponding to a pyramid side) have at least one dimple parameter that differs from the dimples located within a different segment (corresponding to a different pyramid side). For example, a majority of dimples in a first dimple segment may have a same first edge angle and a majority of dimples in a second dimple segment may have a same second edge angle, and the first and second edge angles may be different. By varying a parameter such as edge angle or chord depth for different segments, the aerodynamic performance of the golf ball can be further adjusted as a means of improving both the symmetry and optimization of flight. For example, any asymmetry resulting from the dissimilar segments may be aerodynamically adjusted by varying at least one parameter across the segments. Further, the values for the varied parameters may be chosen such that another parameter (e.g., related to volume, dimple count, etc.) is equalized around the golf ball in order to promote symmetry and help tune aerodynamic performance.

According to some embodiments, dimples within each dimple segment may be constructed to meet more than one target value that differs from or is the same as that of dimples in other dimple segments. For example, in some embodiments, a comparison between dimples in different segments indicates at least one different parameter and at least one same parameter. In some embodiments, the same parameter is dependent on the different parameter (e.g., volume is dependent on edge angle and chord depth). In one example, dimples in one segment may have different edge angles than dimples in another segment, but segment volumes may be proportionally the same (e.g., using a volumetric rate as discussed further below) based on the size of the segment across the multiple segments.

Dimples described herein may be constructed to include a value for an individual variable such as edge angle or chord depth, wherein the value varies depending on the dimple segment. In other embodiments, dimples may also be constructed to include a value related to a second parameter such as dimple volume, plan area, dimple segment volume, total hemisphere dimple volume, total dimple volume, etc., that does not vary across dimple segments. As dimple volume is a function of multiple individual variables (e.g., shape, the diameter, the depth, and the profile of the dimple), some variables may be held constant while others are adjusted in order for the dimples to individually and/or collectively meet targets for multiple variables/parameters (e.g., edge angle and dimple volume or chord depth and dimple volume). In this way, groups of dimples may be made to maintain symmetry of some parameters while allowing for variation of other parameters in order to improve and tune aerodynamic performance.

Dimple volume for an individual dimple is measured based on the shape of the dimple on the surface of the golf ball. Some dimples have a general shape of a portion of a spherical body formed as a depression in the curved, spherical outer surface of the golf ball. The dimple volume of these dimples may be determined based on the result of a calculation using known dimple quantities, including, for example, dimple diameter, surface depth, edge angle, chord depth, etc.

Generally, it may be difficult to measure some dimple parameters due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of variables such as edge angle, chord depth, and dimple diameter somewhat ambiguous. To resolve this problem, the parameters of a dimple 100 on a finished golf ball are measured according to the method shown in FIG. 25.

Figure 25:
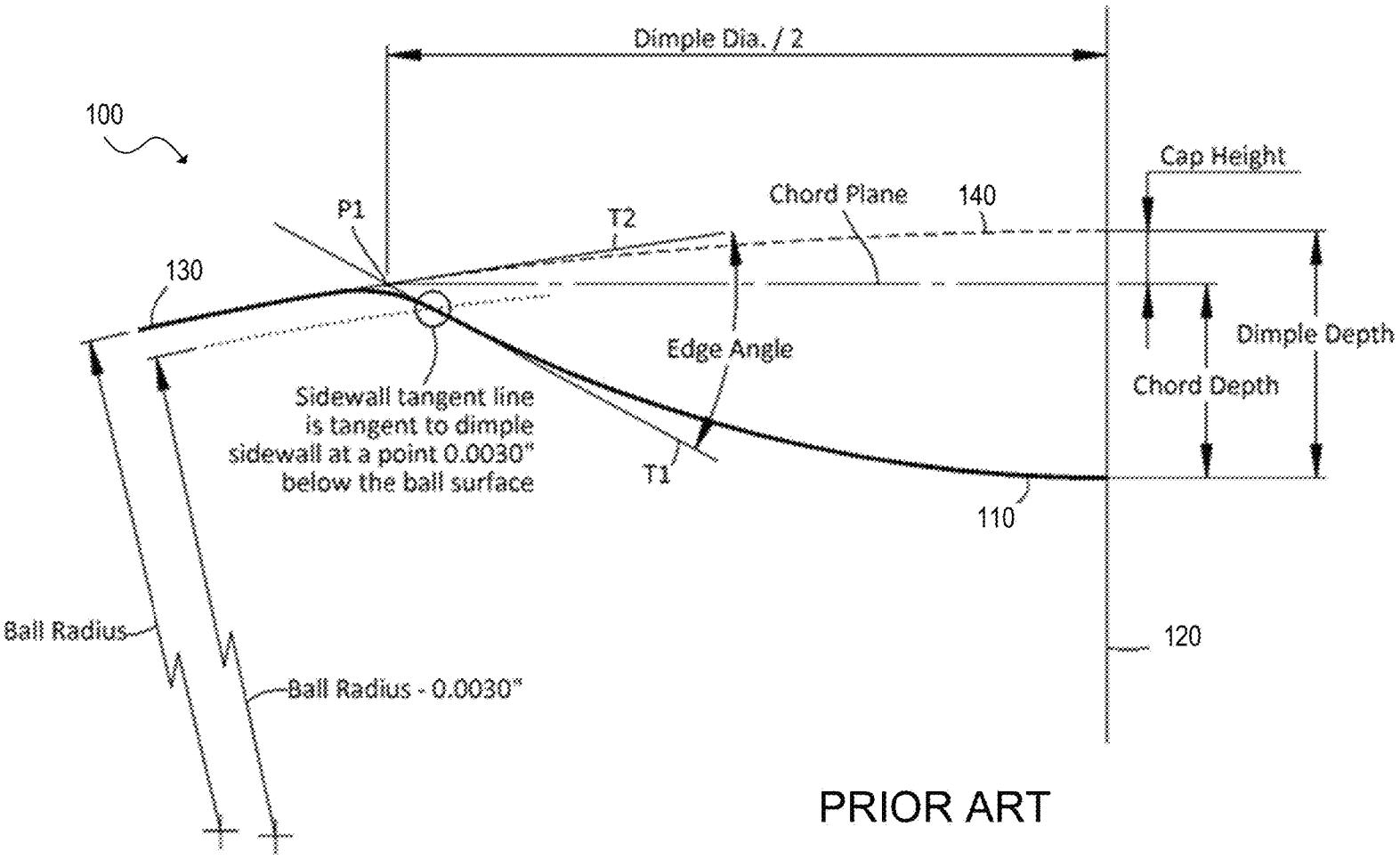
PRIOR ART Fig. 25
FIG. 25 is a schematic diagram illustrating a method for measuring some parameters of a dimple, including edge angle, chord depth, and dimple diameter.

FIG. 25 shows a cross-sectional profile of a dimple surface 110 of the dimple 100, extending from the dimple centerline 120 to the land surface 130 outside of the dimple 100. A ball phantom surface 140 is constructed above the dimple 100 as a continuation of the land surface 130. A first tangent line T1 is then constructed at a point on the dimple sidewall that is spaced 0.003 inches radially inward from the phantom surface 140. T1 intersects phantom surface 140 at a point P1, which defines a nominal dimple edge position. A second tangent line T2 is then constructed, tangent to the phantom surface 140, at P1. The edge angle of the dimple 100 is the angle between T1 and T2. The diameter of the dimple 100 is the distance between P1 and its equivalent point diametrically opposite along the dimple perimeter. Alternatively, the dimple diameter is twice the distance between P1 and the dimple centerline 120, measured in a direction perpendicular to centerline 120. In each of these examples, the measurements occur in the chord plane, which includes the points P1 located around the perimeter of the dimple 100 and point at which the diameter may be measured to the dimple centerline 120.

The depth of the dimple 100 is the distance measured along a ball radius from the phantom surface 140 of the ball to the deepest point on the dimple 100. The volume of the dimple 100 is the space enclosed between the phantom surface 140 and the dimple surface 110 (extended along T1 until it intersects the phantom surface). Another parameter is the chord depth, which is the shortest distance from the chord plane to the deepest point on the dimple 100. The chord depth is less than the dimple depth. The difference between the chord depth and the dimple depth is the cap height, which is the distance from the chord plane to the phantom surface 140 measured at the point of deepest dimple depth (e.g., the dimple centerline 120). The volume between the chord plane and the dimple surface 110 combined with the volume between the chord plane and the phantom surface 140 is the dimple volume.

Figure 26:
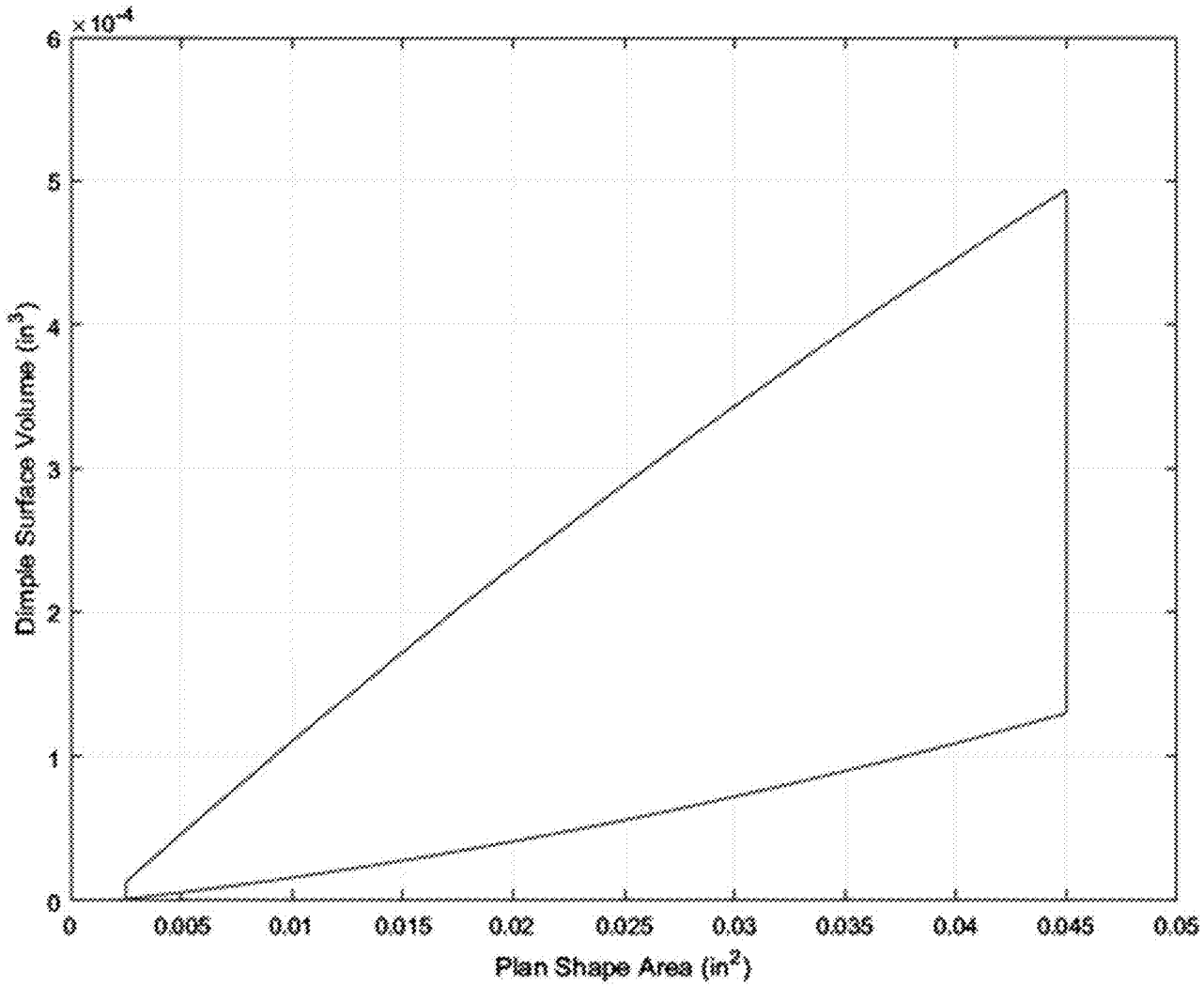
PRIOR ART Fig. 26
FIG. 26 is a graphical representation of the relationship between dimple volume and plan shape area.

In some embodiments, one or more dimples may be non-spherical. Suitable non-spherical dimples preferably have a plan shape area and dimple volume within a range having a lower limit and an upper limit selected from the values within the region shown in FIG. 26, which is a graphical representation of the relationship between dimple volume and plan shape area of non-spherical dimples according to an embodiment of the present invention.

The plan shape area is based on a planar view of the dimple plan shape, such that the viewing plane is normal to an axis connecting the center of the ball to the point of the calculated surface depth. The dimple volume is the total volume encompassed by the dimple shape and the phantom surface of the golf ball. The preferred dimple volume will be less than the upper limit volume calculated by $$V_s = -0.0464x^2 + 0.0135x - 2.00 \times 10^{-5}$$

and greater than the lower limit calculated by $$V_s = 0.0300x^2 + 0.0016x - 3.00 \times 10^{-6}$$

where x is the dimple plan shape area and x is between 0.0025 and 0.045 inclusive.

The diameter of a dimple having a non-circular plan shape is defined by its equivalent diameter, $d_e$, which calculated as:

$$d_e = 2\sqrt{\frac{A}{\pi}}$$

where A is the plan shape area of the dimple.

Non-spherical dimples having a constant angle between the golf ball surface and the dimple surface may be considered to have an edge angle. The edge angle may be defined, for example, as an angle between a first line tangent to the sidewall of the dimple and a second line tangent to the phantom spherical surface. Non-spherical dimples having a non-constant edge angle between the golf ball surface and the dimple surface may have an effective edge angle that is the average of the edge angles taken around the perimeter of the plan shape of the dimple.

For purposes of the present disclosure, dimples have the same dimple diameter if their respective diameters, as measure on a final golf ball, differ by less than 0.005 inches due to manufacturing variances.

For purposes of the present disclosure, the centroid of a dimple determines which hemisphere the dimple is located in. Preferably, the centroid of each dimple intersected by the equator does not lie on the equator.

While golf balls of the present invention are not limited to a particular dimple count, in a particular embodiment, the golf ball has a dimple count of 336 or 338 or 342 or 344 or 349 or 350 or 310 or 316 or 318 or 346 or 354 or 358 or 366 or 396.

EXAMPLES

The examples below are for illustrative purposes only. In no manner is the present invention limited to the specific disclosures therein.

Example 1

Figure 5:
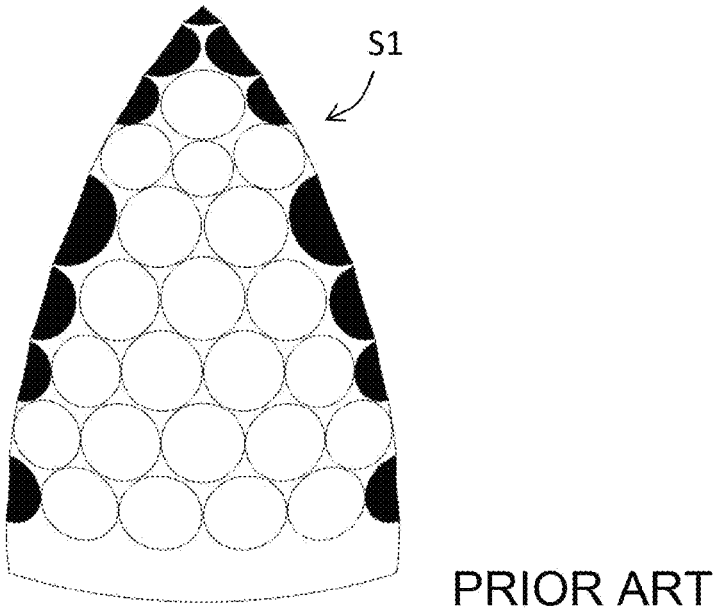
FIG. 5 illustrates a side of a pyramid projected on a hemisphere and packed with dimples.
Figure 6:
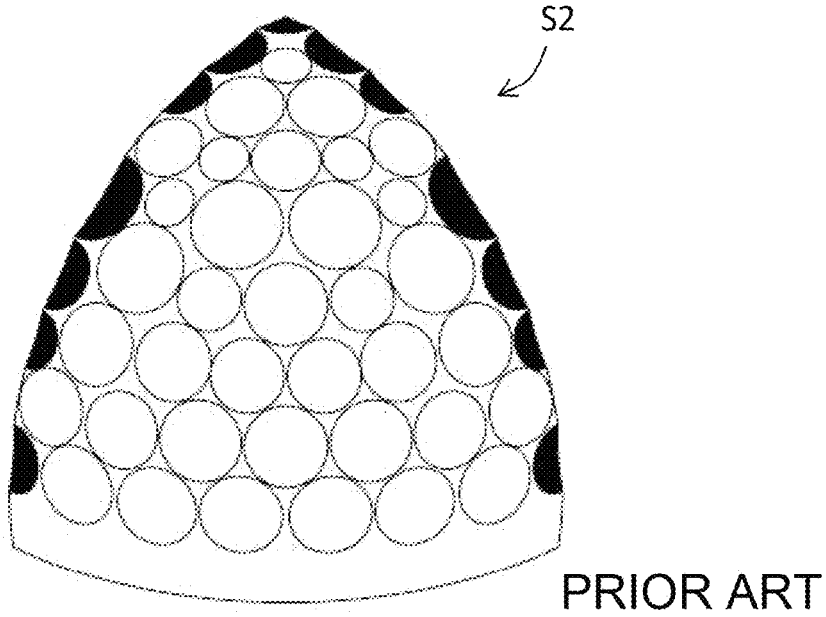
FIG. 6 illustrates a side of a pyramid projected on a hemisphere and packed with dimples.

As shown in FIG. 5, a first side, S1, of a pyramid is projected on a hemisphere and packed with dimples. The first side has a longitudinal angle of 60°. As shown in FIG. 6, a second side, S2, of a pyramid is projected on a hemisphere and packed with dimples in a different arrangement than S1. The second side has a longitudinal angle of 90°. Dimples that intersect the side edges are shaded in FIGS. 5 and 6. Dissimilar sides S1 and S2 can be combined and repeated to form an overall dimple pattern of a golf ball hemisphere having the characteristics given in Table 1 below.

TABLE 1

| Dissimilar Segments, m | Repetitions, $r_i$ | Longitudinal Angle, $\phi_i$ |
|---|---|---|
| S1 | 3 | 60° |
| S2 | 2 | 90° |

Using Equation 3, the total number of sides for the hemisphere, n, is 5. The total number of distinct hemispheres, τ, that can be created is 2, as calculated using Equation 2, $$\tau = \frac{(5-1)!}{2! \times 3!} = 2.$$

Figure 7:
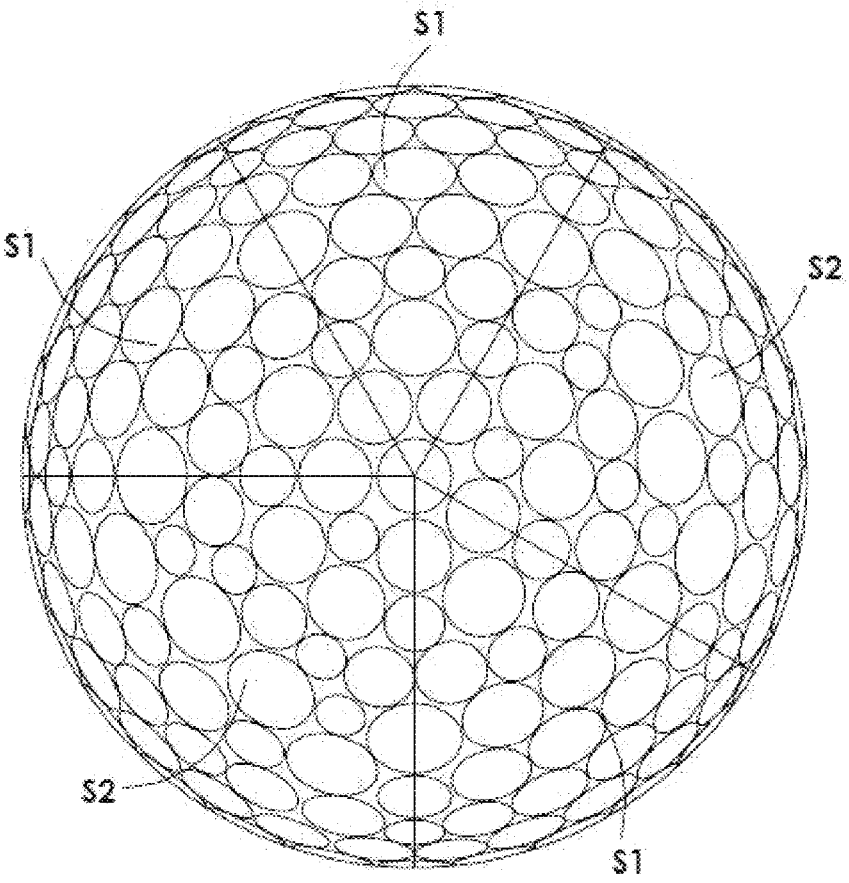
FIG. 7 is a polar view of a golf ball having dimples arranged according to an embodiment of the present invention.
Figure 8:
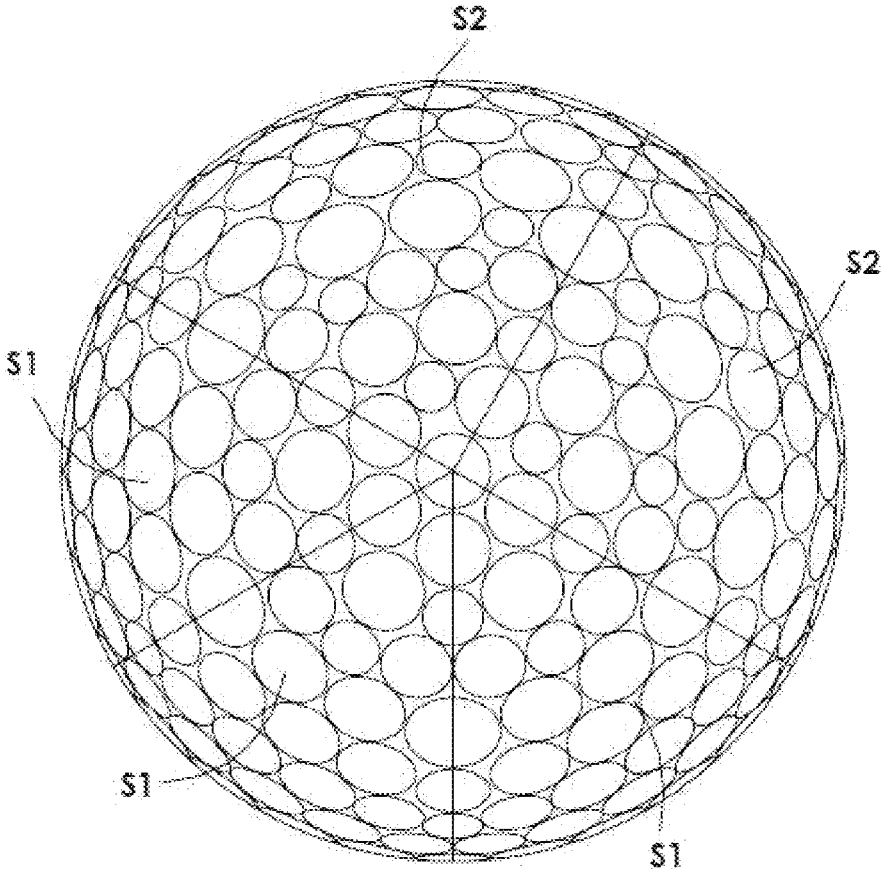
FIG. 8 is a polar view of a golf ball having dimples arranged according to an embodiment of the present invention.

The two distinct hemispheres that can be created are shown in FIGS. 7 and 8. FIG. 7 illustrates a hemisphere with a rotational pattern of {S1,S2,S1,S2,S1}. FIG. 8 illustrates a hemisphere with a rotational pattern of {S2,S2,S1,S1,S1}.

Example 2

Figure 9:
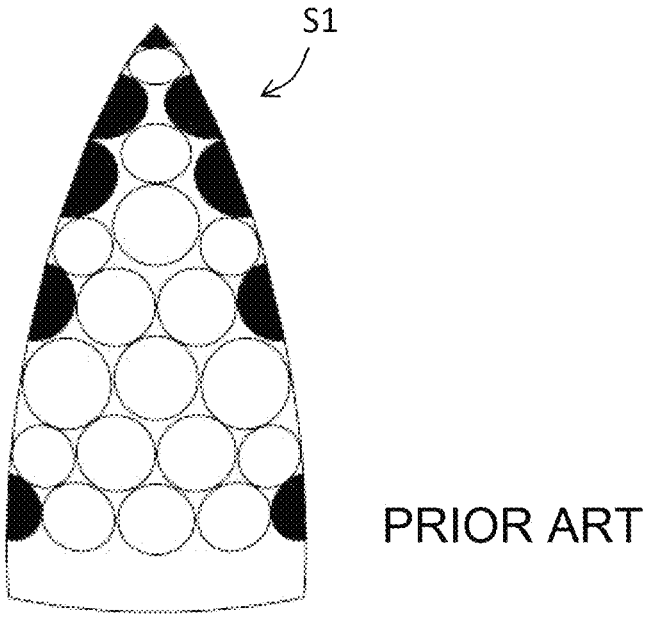
FIG. 9 illustrates a side of a pyramid projected on a hemisphere and packed with dimples.
Figure 10:
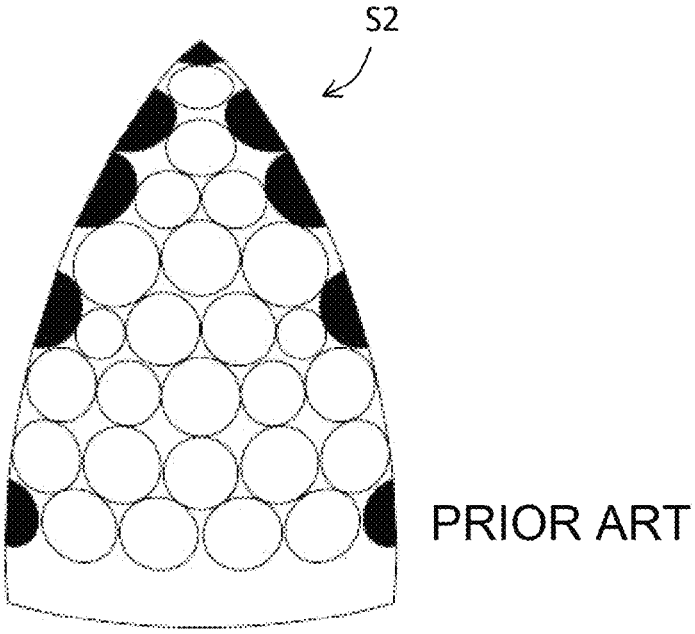
FIG. 10 illustrates a side of a pyramid projected on a hemisphere and packed with dimples.

As shown in FIG. 9, a first side, S1, of a pyramid is projected on a hemisphere and packed with dimples. The first side has a longitudinal angle of 45°. As shown in FIG. 10, a second side, S2, of a pyramid is projected on a hemisphere and packed with dimples in a different arrangement than S1. The second side has a longitudinal angle of 60°. Dimples that intersect the side edges are shaded in FIGS. 9 and 10. Dissimilar sides S1 and S2 can be combined and repeated to form an overall dimple pattern of a golf ball hemisphere having the characteristics given in Table 2 below.

TABLE 2

| Dissimilar Segments, m | Repetitions, $r_i$ | Longitudinal Angle, $\phi_i$ |
|---|---|---|
| S1 | 4 | 45° |
| S2 | 3 | 60° |

Using Equation 3, the total number of sides for the hemisphere, n, is 7. The total number of distinct hemispheres, τ, that can be created is 5, as calculated using Equation 2, $$\tau = \frac{(7-1)!}{4! \times 3!} = 5.$$

Figure 11:
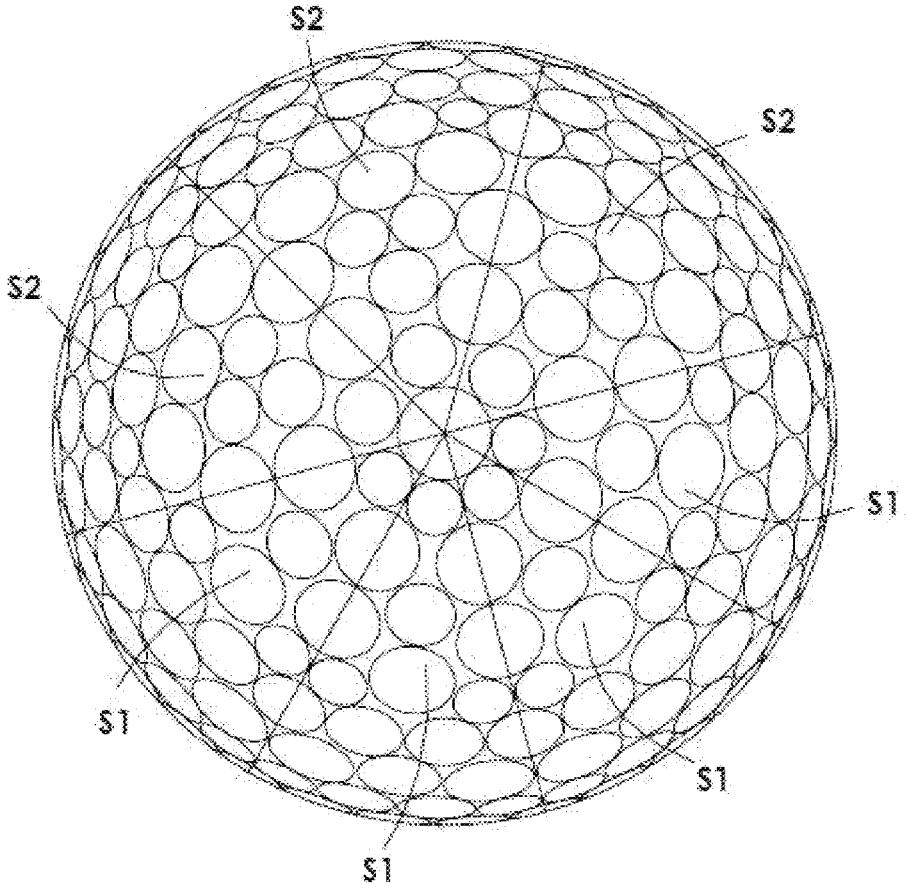
FIG. 11 is a polar view of a golf ball having dimples arranged according to an embodiment of the present invention.
Figure 12:
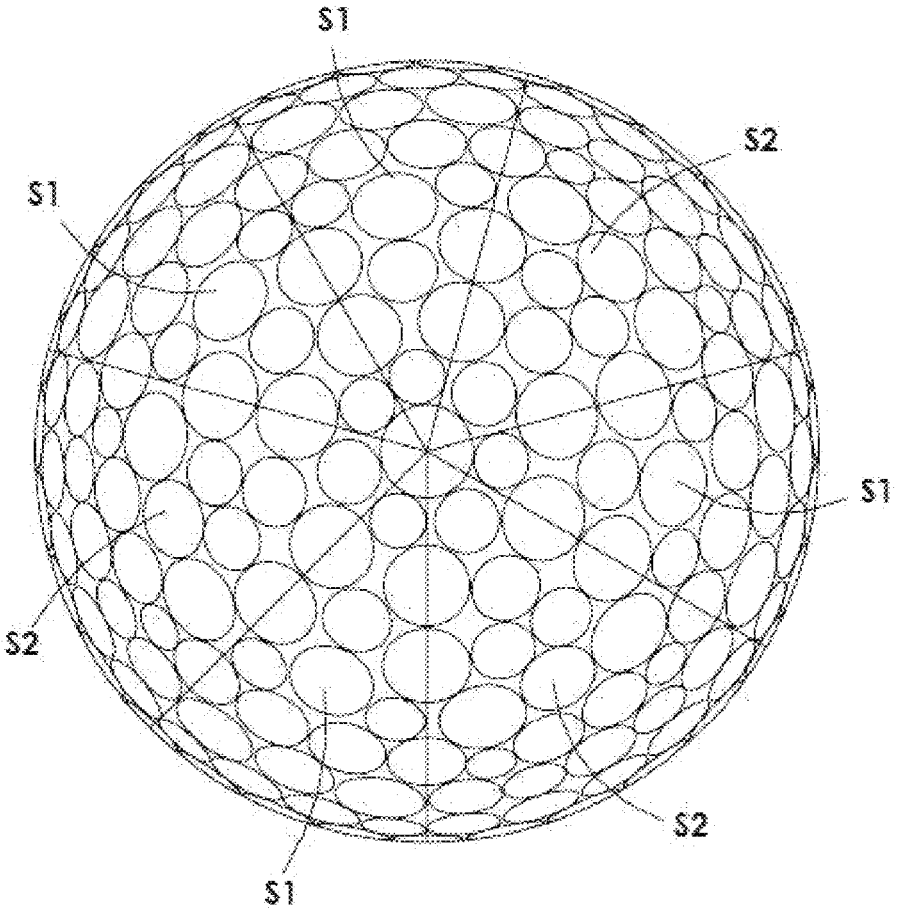
FIG. 12 is a polar view of a golf ball having dimples arranged according to an embodiment of the present invention.

Two of the five distinct hemispheres that can be created are shown in FIGS. 11 and 12. FIG. 11 illustrates a hemisphere with a rotational pattern of {S1,S1,S1,S2,S2,S2,S2}. FIG. 12 illustrates a hemisphere with a rotational pattern of {S1,S1,S2,S1,S2,S1,S2}.

Example 3

Figure 13:
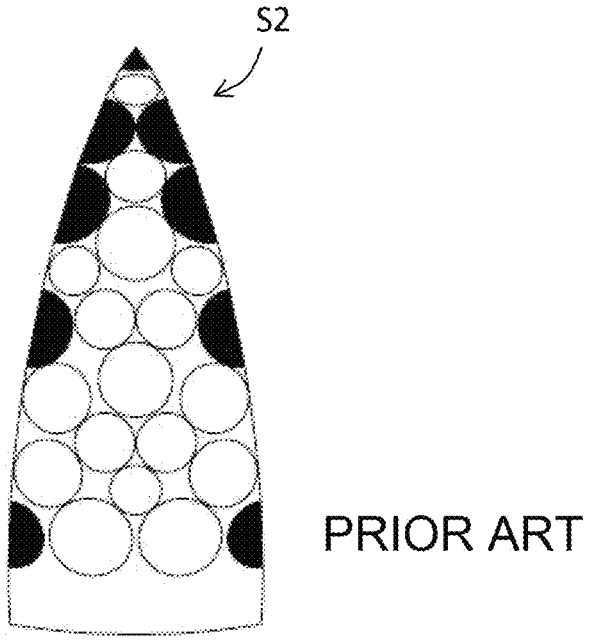
FIG. 13 illustrates a side of a pyramid projected on a hemisphere and packed with dimples.
Figure 14:
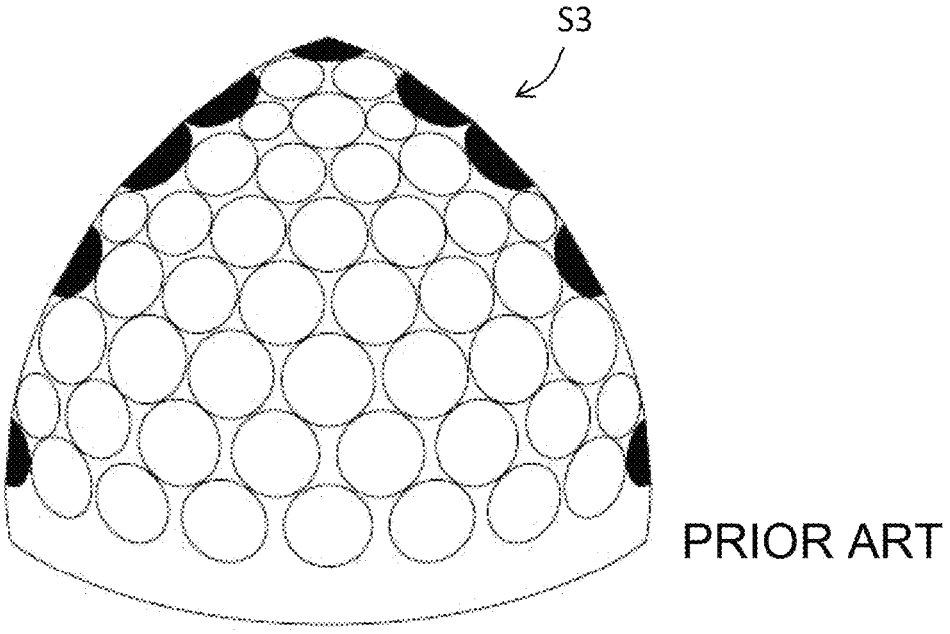
FIG. 14 illustrates a side of a pyramid projected on a hemisphere and packed with dimples.

As shown in FIG. 9, a first side, S1, of a pyramid is projected on a hemisphere and packed with dimples. The first side has a longitudinal angle of 45°. As shown in FIG. 13, a second side, S2, of a pyramid is projected on a hemisphere and packed with dimples in a different arrangement than S1. The second side has a longitudinal angle of 38°. As shown in FIG. 14, a third side, S3, of a pyramid is projected on a hemisphere and packed with dimples in a different arrangement than S1 or S2. The third side has a longitudinal angle of 111°. Dimples that intersect the side edges are shaded in FIGS. 9, 13 and 14. Dissimilar sides S1, S2 and S3 can be combined and repeated to form an overall dimple pattern of a golf ball hemisphere having the characteristics given in Table 3 below.

TABLE 3

| Dissimilar Segments, m | Repetitions, $r_i$ | Longitudinal Angle, $\phi_i$ |
|---|---|---|
| S1 | 3 | 45° |
| S2 | 3 | 38° |
| S3 | 1 | 111° |

Using Equation 3, the total number of sides for the hemisphere, n, is 7. The total number of distinct hemispheres, τ, that can be created is 20, as calculated using Equation 2, $$\tau = \frac{(7-1)!}{3! \times 3! \times 1!} = 20.$$

Figure 15:
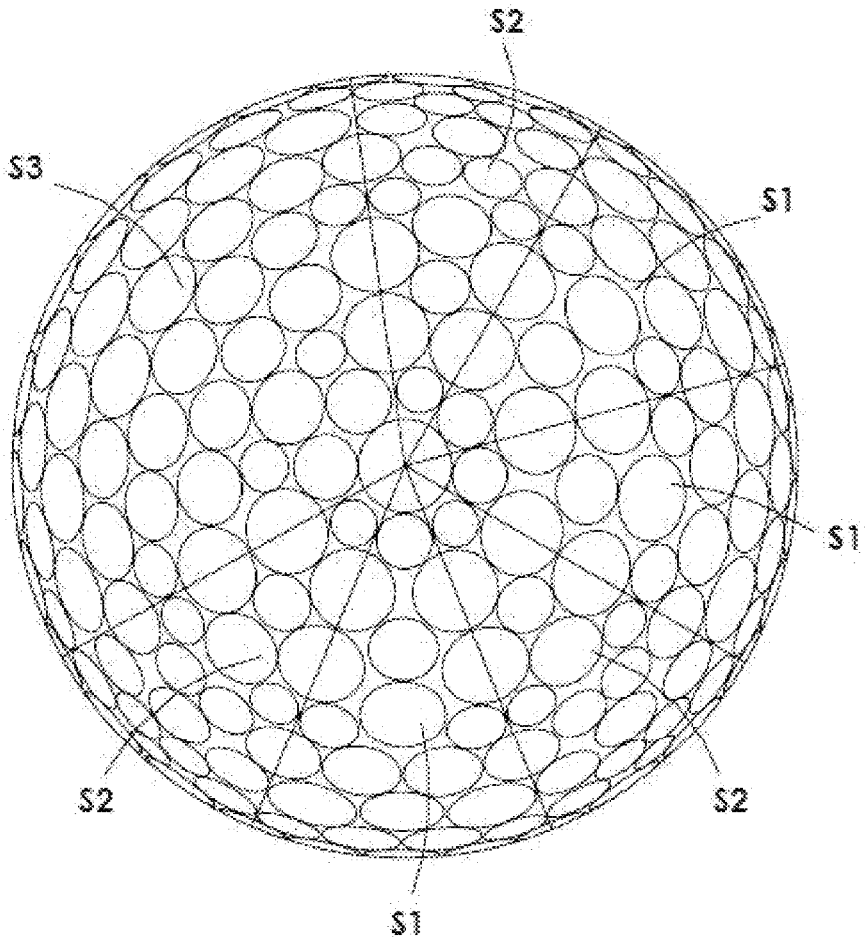
FIG. 15 is a polar view of a golf ball having dimples arranged according to an embodiment of the present invention.

One of the twenty distinct hemispheres that can be created is shown in FIG. 15, which illustrates a hemisphere with a rotational pattern of {S2,S1,S1,S2,S1,S2,S3}.

Example 4

Figure 16:
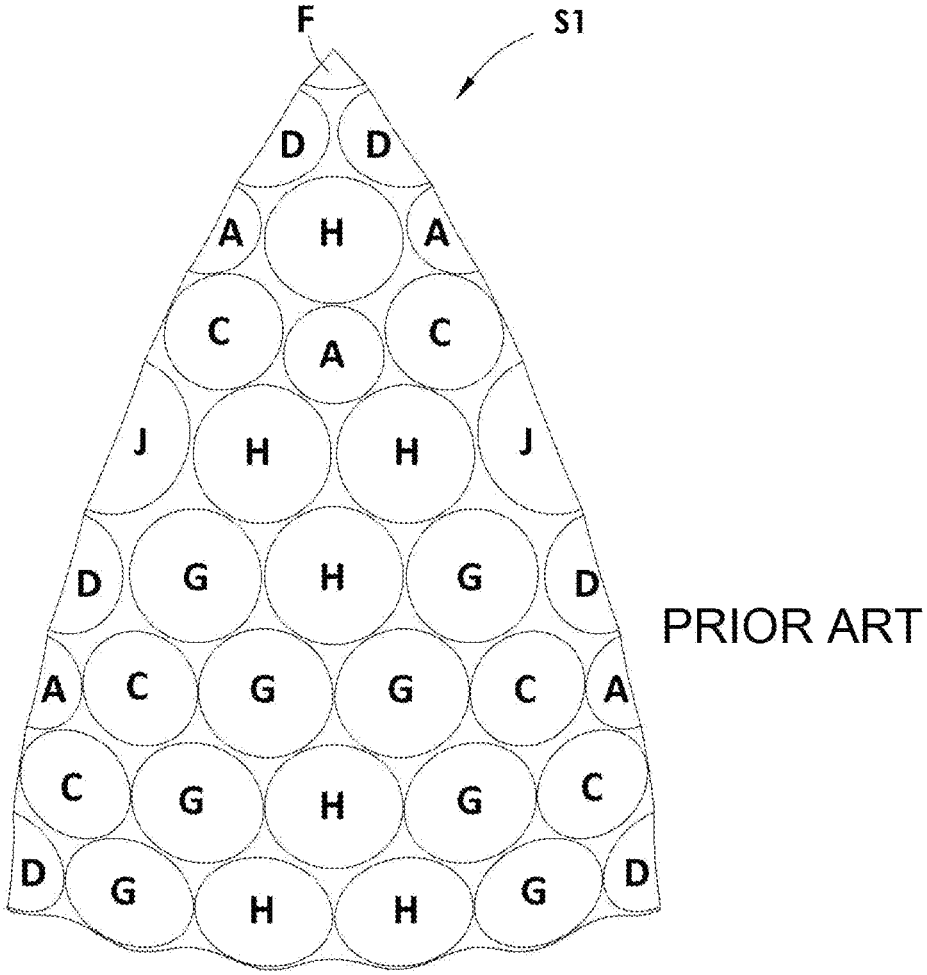
FIG. 16 illustrates a side of a pyramid projected on a hemisphere and packed with dimples.
Figure 17:
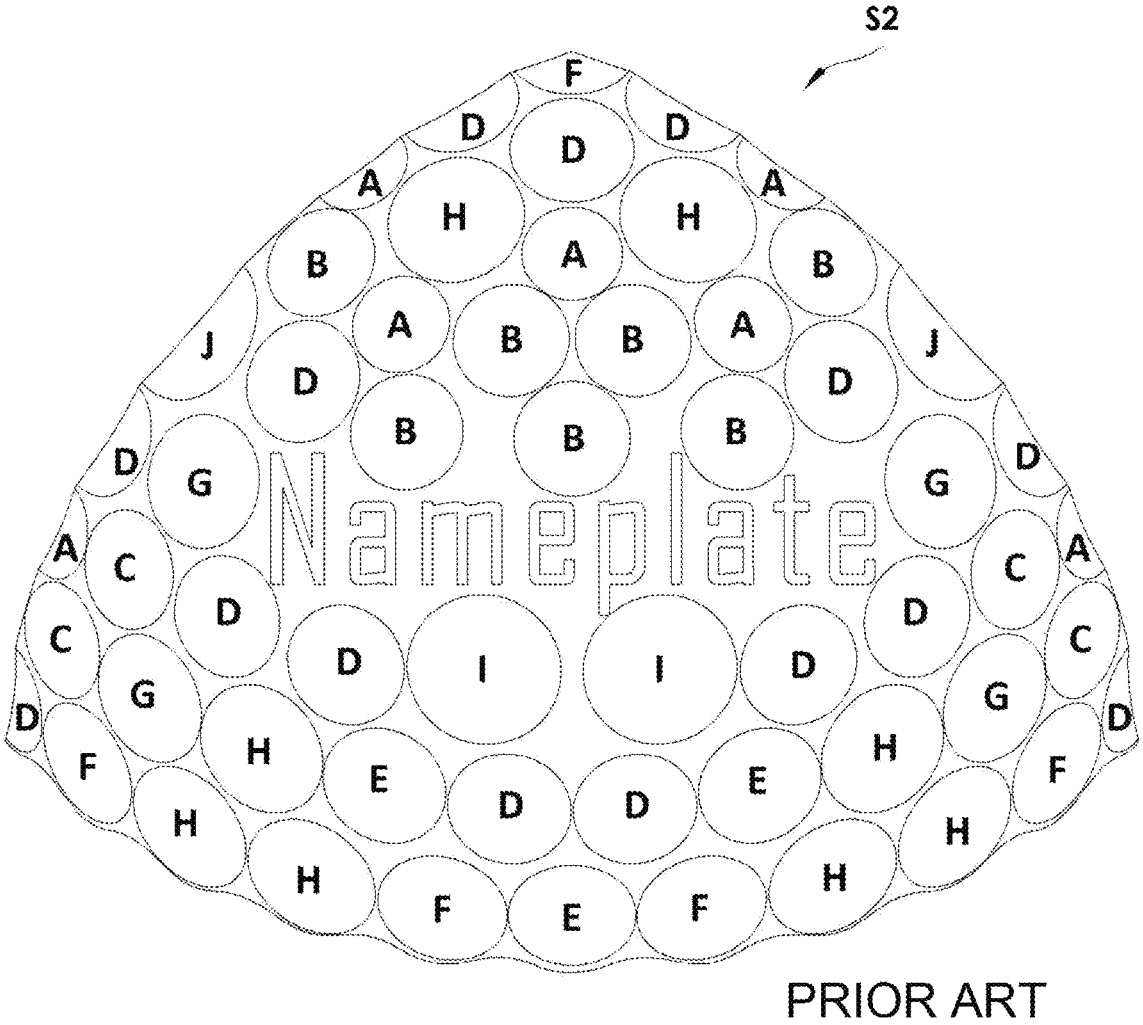
PRIOR ART FIG. 17
FIG. 17 illustrates a side of a pyramid projected on a hemisphere and packed with dimples.
Figure 18:
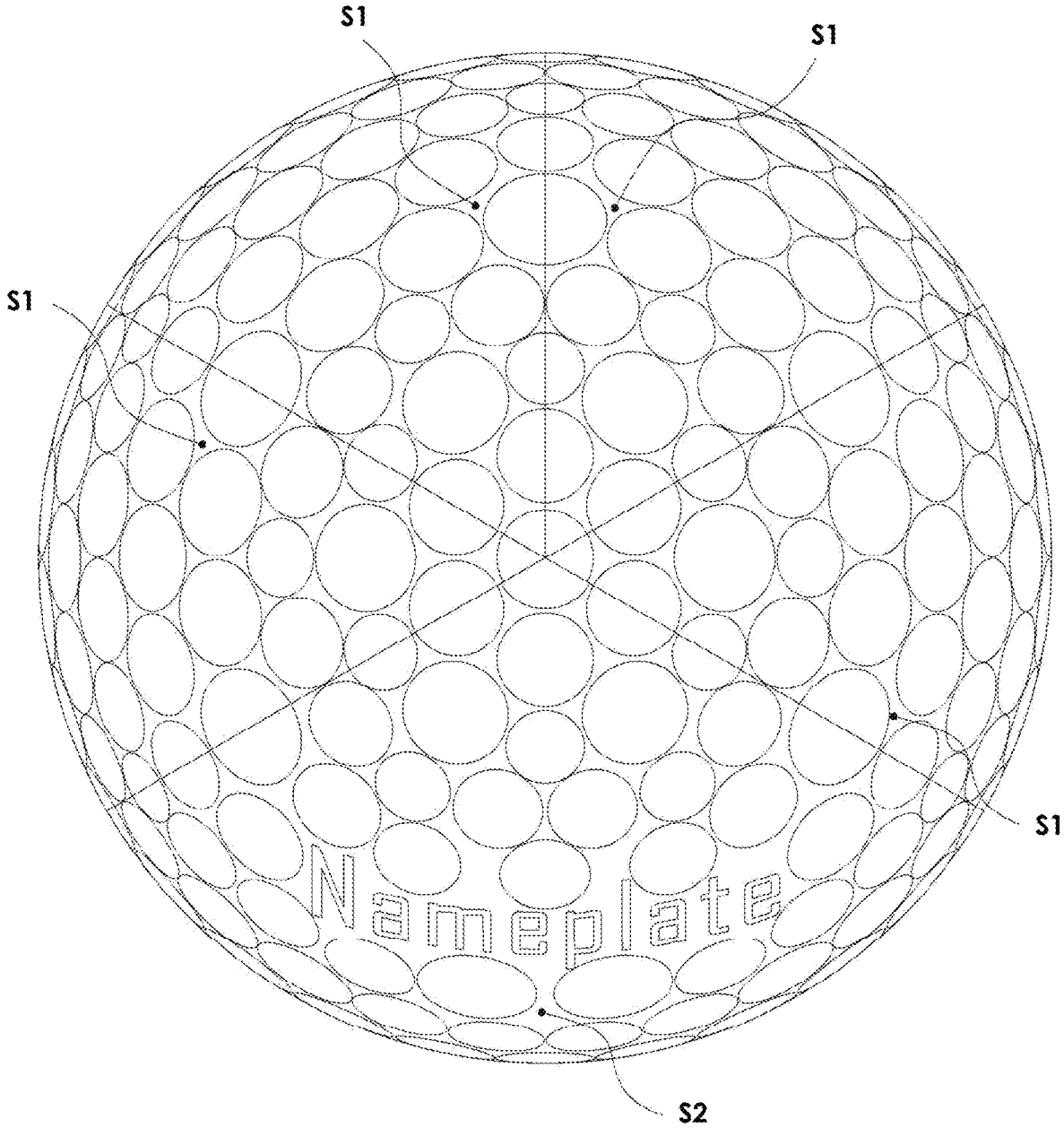
FIG. 18 illustrates a polar view of a golf ball having dimples arranged according to an embodiment of the present invention.

As shown in FIG. 16, a first side, S1, of a pyramid is projected on a hemisphere and packed with dimples. The first side has a longitudinal angle of 60°. As shown in FIG. 17, a second side, S2, of a pyramid is projected on a hemisphere and packed with dimples in a different arrangement than S1, and includes a dimple free area with a marking. The second side has a longitudinal angle of 120°. First side S1 can be repeated and combined with second side S2 to form the overall dimple pattern of a golf ball hemisphere shown in FIG. 18, which illustrates a hemisphere with a rotational pattern of {S1,S1,S1,S1,S2}. In a particular example of the embodiment shown in FIGS. 16-18, a golf ball is provided wherein both hemispheres of the ball have the dimple pattern shown in FIG. 18.

Figure 19:
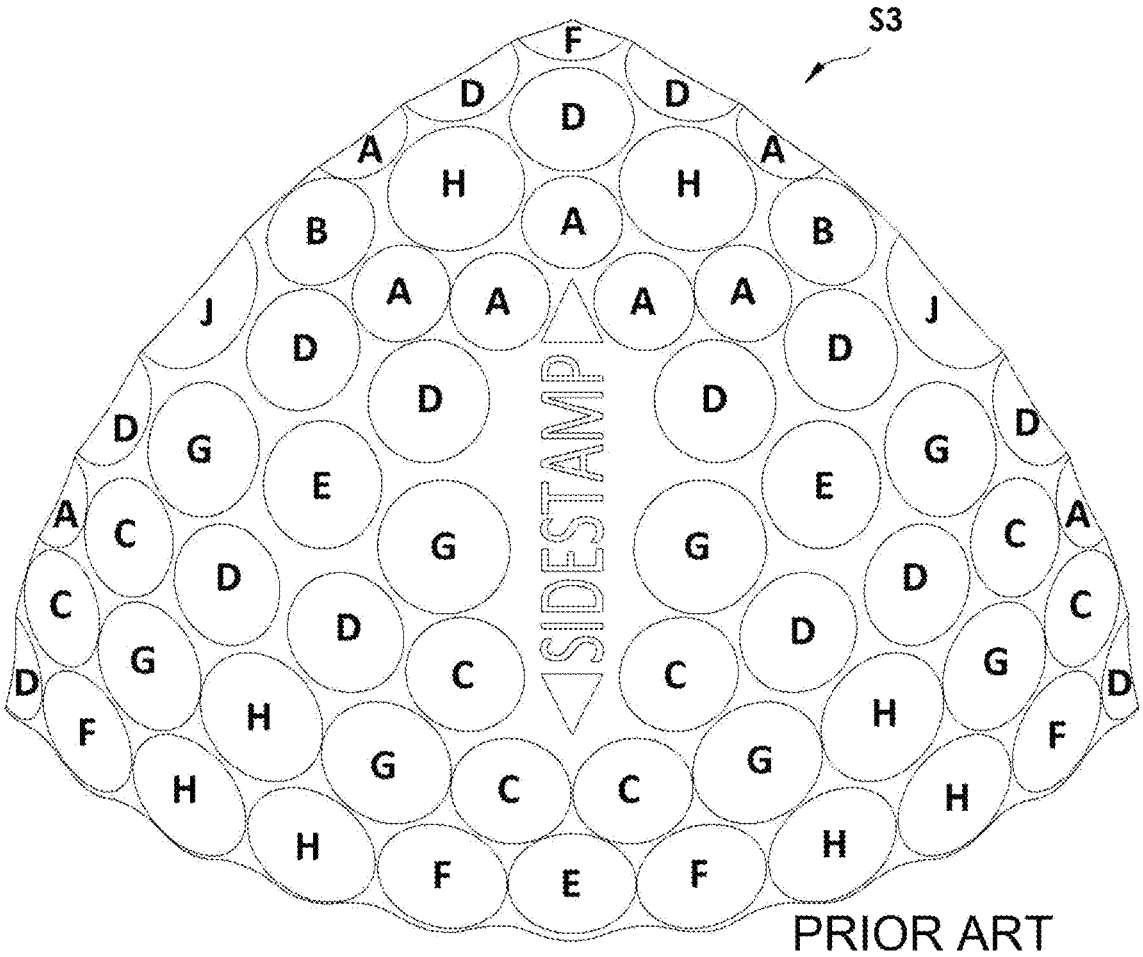
FIG. 19 illustrates a side of a pyramid projected on a hemisphere and packed with dimples.
Figure 20:
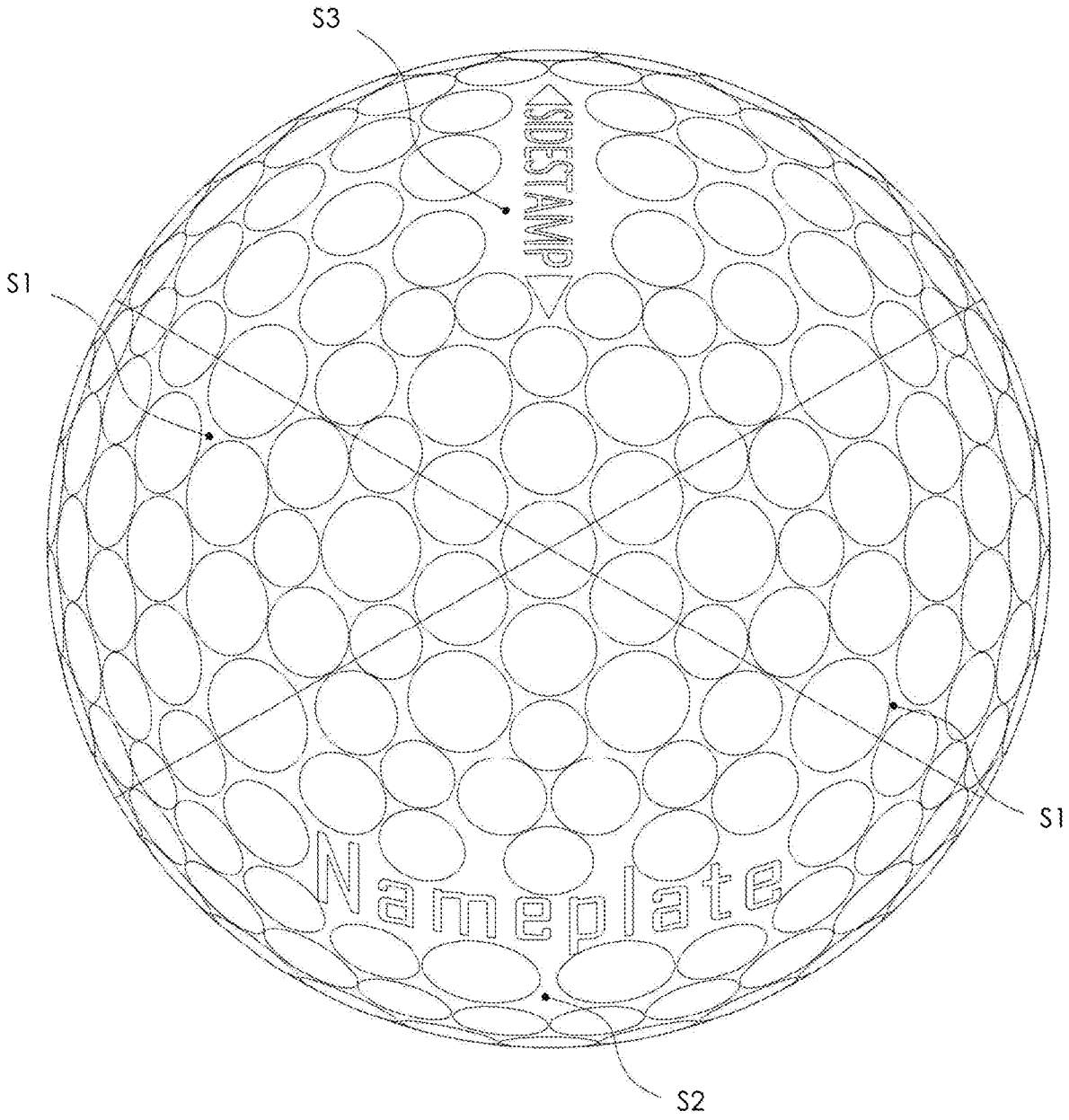
FIG. 20 illustrates a polar view of a golf ball having dimples arranged according to an embodiment of the present invention.

As shown in FIG. 19, a third side, S3, of a pyramid is projected on a hemisphere and packed with dimples in a different arrangement than S1 or S2, and includes a dimple free area with a marking. The third side has a longitudinal angle of 120°. First side S1 of FIG. 16 can be repeated and combined with second side S2 of FIG. 17 and third side S3 of FIG. 19 to form the overall dimple pattern of a golf ball hemisphere shown in FIG. 20, which illustrates a hemisphere with a rotational pattern of {S1,S2,S1,S3}. In a particular example of the embodiment shown in FIGS. 16, 17, 19 and 20, a golf ball is provided wherein both hemispheres of the ball have the dimple pattern shown in FIG. 20.

In FIGS. 16, 17 and 19, the alphabetical labels within the dimples designate same diameter dimples. For example, all dimples labelled A have the same diameter; all dimples labelled B have the same diameter; and so on. Table 4 below gives illustrative values for dimple diameter and edge angle for a non-limiting particular example of the embodiments shown in FIGS. 16-20, wherein the dimples are spherical dimples having a circular plan shape and a cross-sectional profile defined by a spherical function.

TABLE 4

| Dimple Label | Dimple Diameter (in) | Edge Angle (°) |
|---|---|---|
| A | 0.130 | 14.8 |
| B | 0.150 | 14.8 |
| C | 0.155 | 14.8 |
| D | 0.160 | 14.8 |
| E | 0.165 | 14.8 |
| F | 0.170 | 14.8 |
| G | 0.175 | 14.8 |
| H | 0.180 | 14.8 |
| I | 0.200 | 14.8 |
| J | 0.205 | 14.8 |

Example 5

Figure 21:
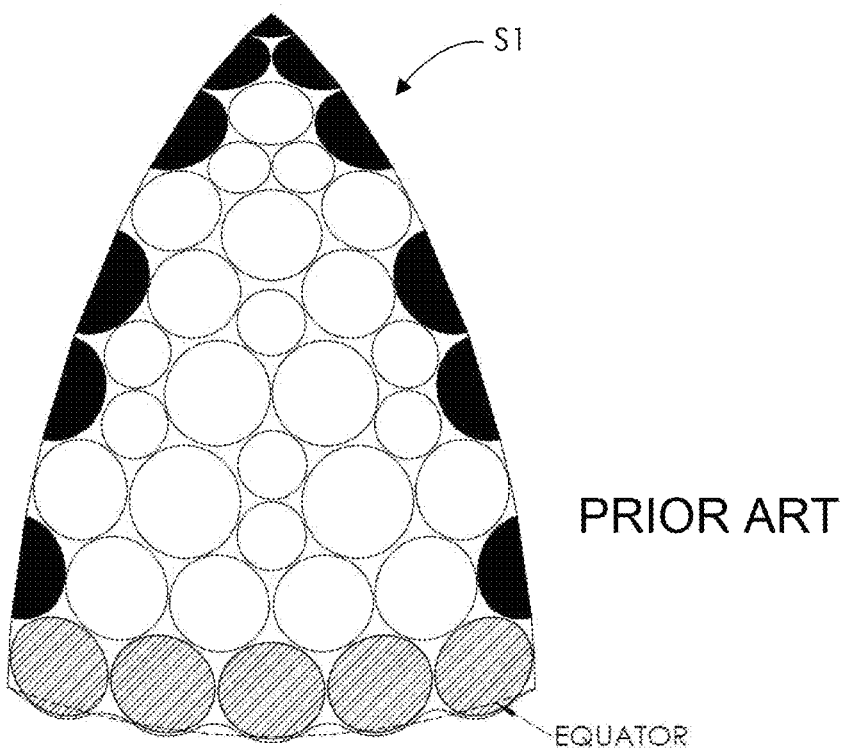
FIG. 21 illustrates a side of a pyramid projected on a hemisphere and packed with dimples.
Figure 22:
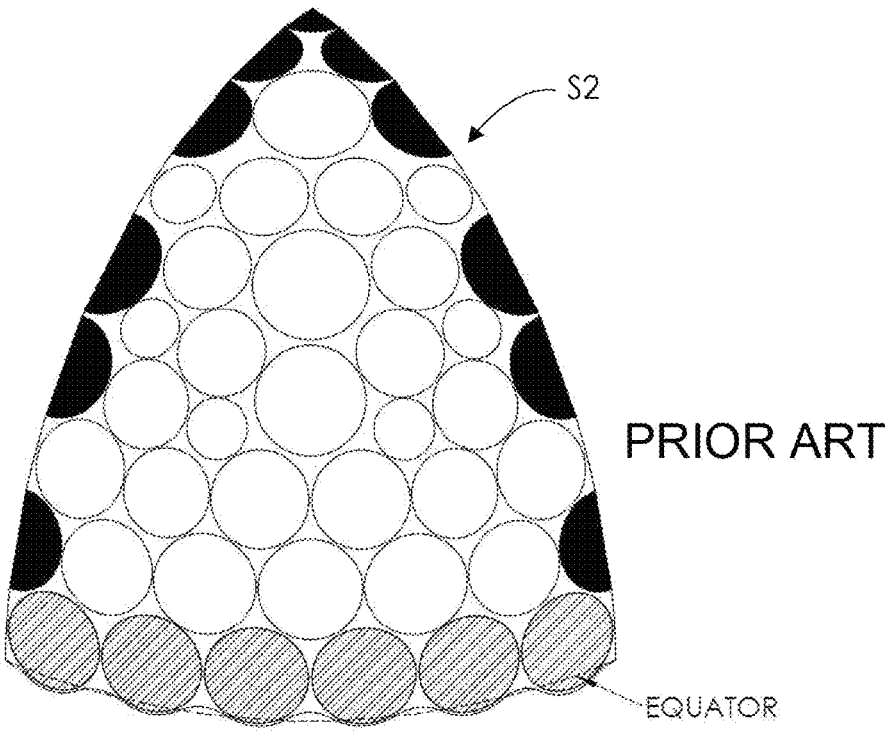
FIG. 22 illustrates a side of a pyramid projected on a hemisphere and packed with dimples.
Figure 23:
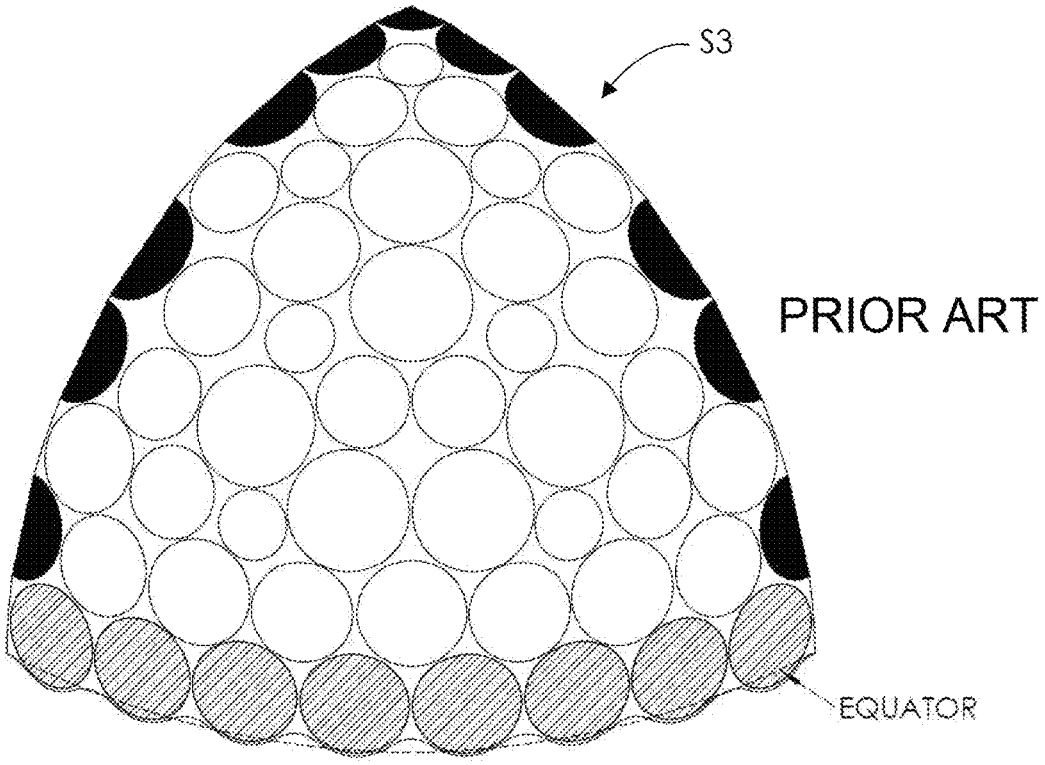
FIG. 23 illustrates a side of a pyramid projected on a hemisphere and packed with dimples.

As shown in FIG. 21, a first side, S1, of a pyramid is projected on a hemisphere and packed with dimples. The first side has a longitudinal angle of 60°. As shown in FIG. 22, a second side, S2, of a pyramid is projected on a hemisphere and packed with dimples in a different arrangement than S1. The second side has a longitudinal angle of 72°. As shown in FIG. 23, a third side, S3, of a pyramid is projected on a hemisphere and packed with dimples in a different arrangement than S1 or S2. The third side has a longitudinal angle of 96°. In FIGS. 21-23, dimples that intersect the side edges are shaded black, and dimples that intersect the equator are indicated by hatch mark shading.

Figure 24:
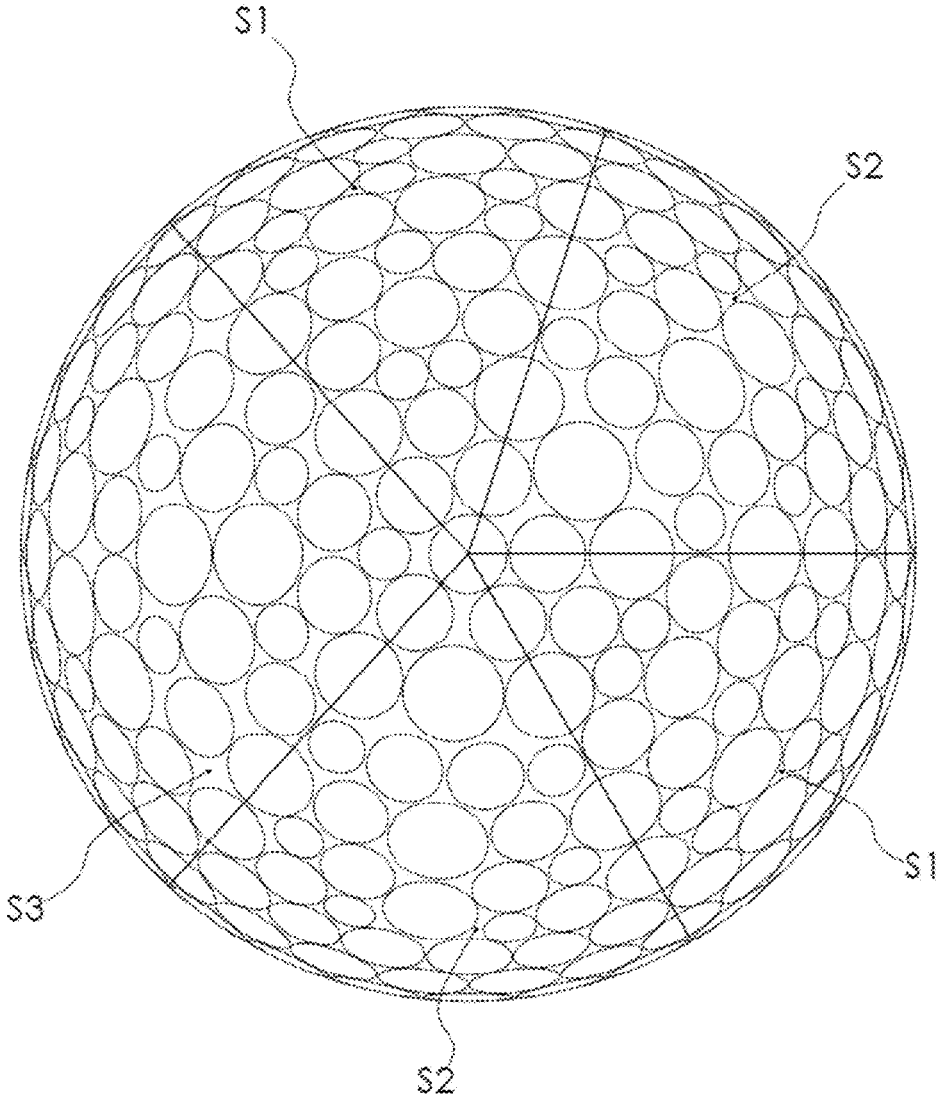
FIG. 24 illustrates a polar view of a golf ball having dimples arranged according to an embodiment of the present invention.

First side S1 and second side S2 can be repeated and combined with third side S3 to form the overall dimple pattern of a golf ball hemisphere shown in FIG. 24, which illustrates a hemisphere with a rotational pattern of {S1,S2,S1,S2,S3}.

In a particular embodiment of the dimple pattern shown in FIGS. 21-24, all of the dimples that intersect the equator, i.e., all of the dimples indicated by hatch mark shading, have the same diameter.

Example 6

Figure 27:
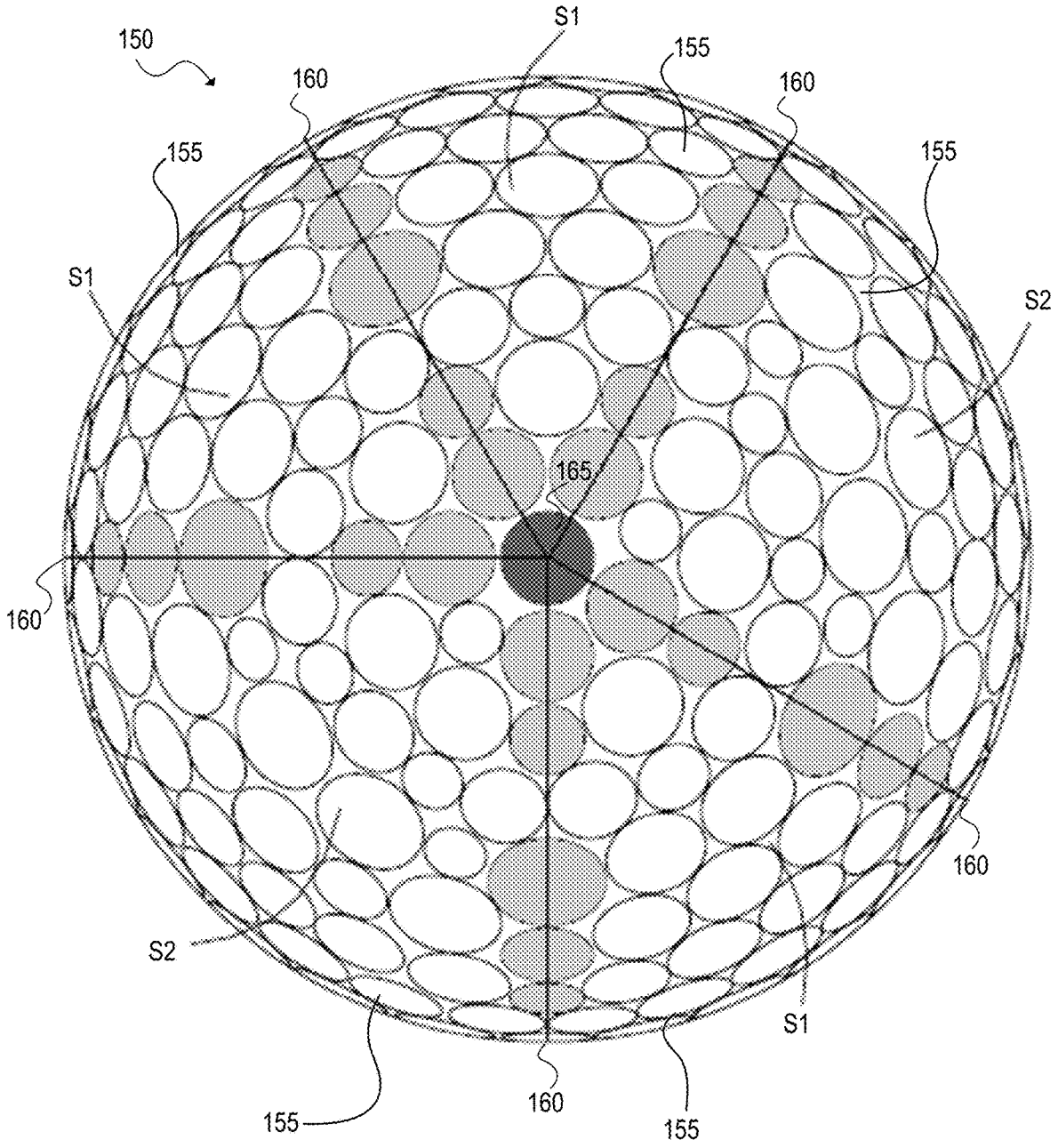
FIG. 27 illustrates a polar view of a golf ball having dimples arranged according to an embodiment of the present invention.

FIG. 27 shows a hemisphere of a golf ball 150 having a plurality of dimples arranged in a dimple pattern consistent with disclosed embodiments. The dimple pattern of the golf ball 150 is broken into a plurality of dimple segments 155 defined by an n-sided pyramid projected onto the hemisphere. The projection of the pyramid creates n longitudinal lines 160 from the pole to the equator. Each segment 155 includes a plurality of dimples. As described herein, each of the n longitudinal lines 160 intersects a plurality of dimples. The dimple arrangement along each of the n longitudinal lines 160 is identical, and every longitudinal line 160 having said identical dimple arrangement thereon corresponds to one of the side edges of the pyramid upon which the dimple segments 155 are based. In disclosed embodiments, the dimple arrangement along the longitudinal lines 160 may be considered identical based on the diameter and plan shape of the dimples, even if other parameters, such as edge angle and/or chord depth differ.

The golf ball 150 also may include a polar dimple 165 that is intersected by all of the longitudinal lines 160. Dimples intersected by the longitudinal lines 160 (including or not including the polar dimple 165) may be referred to herein as "shared dimples" and may have their own dimple parameters. Dimples near the equator of the golf ball 150 may be intersected by the equator, but are considered to be wholly within a dimple segment if a majority of the dimple or the dimple centroid is in the dimple segment. For example, the dimples along the equator in FIGS. 21 and 22 are considered to be wholly within the shown dimple segments and are not shared dimples unless the equator intersects the centroid of dimples, in which they would be considered shared dimples.

In an exemplary embodiment, each dimple segment 155 has dimple segment parameters, including, for example, one or more of a segment edge angle, a segment chord depth, a segment dimple depth, a segment profile shape, and a segment plan shape. For these examples, the segment parameter value is equal to the value of the parameter for the majority of the dimples in that dimple segment. For example, if a majority of dimples in a dimple segment have an edge angle of 12.0°, then the segment edge angle is 12.0°. In another example, if a majority of dimples in a dimple segment have a catenary curve profile shape, then the segment profile shape is catenary curve. These segment parameters may be determined without considering or including the shared dimples on the longitudinal lines. In some embodiments, the majority producing a segment parameter includes more than 50% of the dimples. In other embodiments, the majority includes more than 75%. In another embodiment, the majority includes more than 90%. In another embodiment, the majority includes 100% of the dimples in the segment (e.g., all of the dimples have the same edge angle, chord depth, etc.).

Another example of a dimple segment parameter is dimple segment volume, which is the total volume of the dimples in a dimple segment, as described herein. For the purposes of this example, the dimple segment volume includes the portion of the dimple volume contributed by the shared dimples within the dimple segment. In the example of FIG. 27, the dimple volume for a dimple segment 155 includes the sum of the dimple volumes for all of the dimples in that hemisphere and wholly within the longitudinal lines 160 in addition to half of the volume of the shared dimples (shown with light shading) on the first longitudinal line edge, half of the volume of the shared dimples on the opposite longitudinal line edge, and the portion of the polar dimple 165 (shown with dark shading) that is in the dimple section, based on the segment longitudinal angle, $\phi_i$.

In one example, dimple segments also have a volume proportion. The volume proportion is a measure of the fraction of the total hemisphere dimple volume that is contributed by a dimple segment. The volume proportion (Vp) for a golf ball having n segments per hemisphere, where the hemisphere has a total hemisphere dimple volume, is shown by the following equation:

$$Vp = \frac{\text{Dimple Segment Volume}}{\text{Total Hemisphere Dimple Volume}}$$

The volume proportion may be separately calculated for each hemisphere if the hemispheres contribute different amounts to the total dimple volume.

Another dimple segment parameter is the longitudinal angle, $\phi_i$. As described herein, a longitudinal angle of a dimple segment is an angular measure of the size of the dimple segment relative to the hemisphere of the golf ball. In the example of FIG. 27, the smaller dimple segments 155 (S1) each have a longitudinal angle of 60°. The larger dimple segments 155 (S2) have a longitudinal angle of 90°. These parameters may also be expressed as a size proportion of the total size of the hemisphere (i.e., 360°). For example, the S1 dimple segments have a size proportion (Sp) equal to 60°/360° or ⅙. The S2 dimple segments have a size proportion Sp) equal to 90°/360° or ¼.

As a way to describe a relationship between the volume proportion and the size proportion of a given segment, a segment volume rate may be determined. The segment volume rate is equal to $$\frac{\text{dimple segment volume}}{\text{segment longitudinal angle}}.$$

In some embodiments, the volume proportion Vp is set to be equal to the size proportion Sp for each segment for each hemisphere of the golf ball. In these instances, the segment volume rate is equal between all segments.

In a particular example of the embodiment shown in FIG. 27, the golf ball 150 is provided wherein both hemispheres of the ball have the dimple pattern shown. The golf ball 150 includes five segments 155—three S1 segments and two S2 segments. In the depicted embodiment, the three S1 segments are identical to each other and the two S2 segments are identical to each other. In other embodiments, at least one additional different segment S3 may be present with at least one different dimple segment parameter. S3 segments may have the same longitudinal angle as S1 or S2 segments. In one embodiment, the segments S1 and S2 may have segment edge angles that are different by at least 0.1 degrees and by half a degree or less, one degree or less, two degrees or less, or at least two degrees. In some embodiments, the edge angles in each segment are between 11 degrees and 15 degrees. In some other embodiments, the edge angles in each segment are between 12 and 14 degrees.

In another example, the segments S1 and S2 have segment chord depths that are different by at least 0.0001 inches and by 0.005 inches or less, 0.010 inches or less, 0.020 inches or less, or at least 0.020 inches. In some embodiments, the chord depths in each segment are between 0.0025 inches and 0.0065 inches. In another embodiment, the chord depths in each segment are between 0.0035 inches and 0.0055 inches.

The shared dimples (shown in light and dark shading in FIG. 27) between the dimple segments are bisected by the longitudinal lines that define the segments. The shared dimples may as a group have a parameter that is common across the shared dimples. For example, each shared dimple may have the same edge angle. In another example, the shared dimples for each longitudinal line have an edge angle corresponding to the segment edge angle of one of the adjacent segments. In another example, the shared dimples for each longitudinal line have an edge angle that differs from the segment edge angle of both its adjacent segments. In another example, the shared dimples all have the same chord depth. In another example, the shared dimples for each longitudinal line have a chord depth corresponding to the segment chord depth of one of the adjacent segments. In another example, the shared dimples for each longitudinal line have a chord depth that differs from the segment chord depth of both its adjacent segments.

In one embodiment, the dimple pattern of the golf ball hemisphere 150 includes at least two segments that have different values for at least one segment parameter. For example, the segments S1 may have a first segment edge angle and the segments S2 may have a second, different segment edge angle. In another example, the segments S1 may have a first segment chord depth and the segments S2 may have a second, different segment chord depth. The dimple segments S1 and S2 may have the characteristics in at least one of the tables shown below.

TABLE 5

| Segment | Edge Angle |
|---|---|
| S1 | 12.0° |
| S2 | 13.0° |

TABLE 6

| Segment | Chord Depth |
|---|---|
| S1 | 0.0035 in. |
| S2 | 0.0045 in. |

In other examples, the dimples in the different segments S1 and S2 may have different shapes, such as different segment dimple profiles or segment dimple plan shapes. In another example, a majority of the dimples in one segment may be spherical while a majority of the dimples in another section may be non-spherical. In another example, the different segments S1 and S2 may have multiple different segment parameters, such as different edge angles and chord depths.

In some embodiments, the golf ball 150 that includes at least one different segment parameter may also include another segment parameter that is equal for all of the segments. For example, the segments S1 and S2 may have the same segment volume rate, for example as shown in Table 7.

TABLE 7

| Segment | Segment Volume Rate |
|---|---|
| S1 | $1.44 \times 10^{-6}$ in$^3$ per degree |
| S2 | $1.44 \times 10^{-6}$ in$^3$ per degree |

Figure 28:
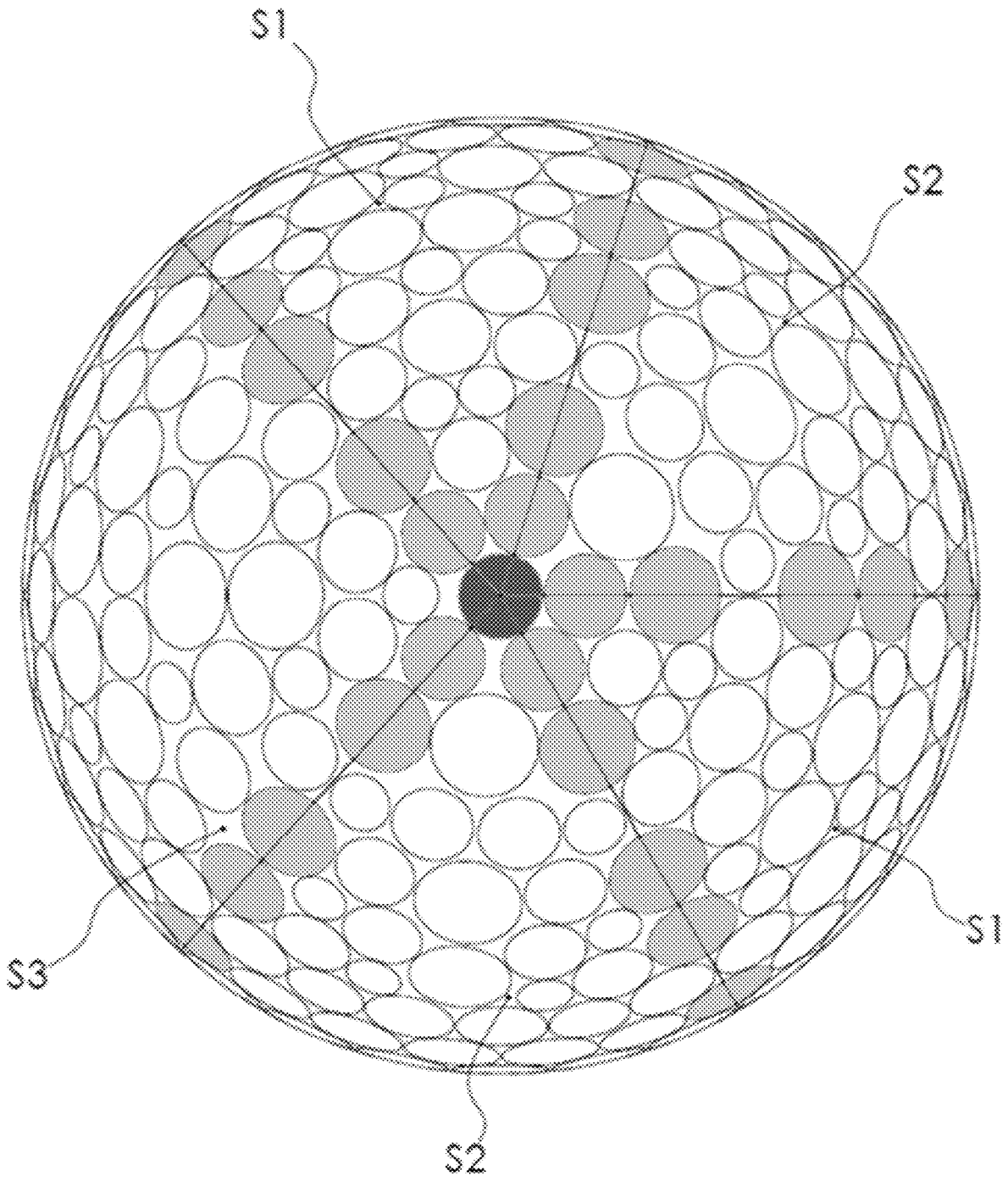
FIG. 28 illustrates a polar view of another golf ball having dimples arranged according to another embodiment of the present invention.

FIG. 28 is another example of a golf ball according to disclosed embodiments. The golf ball includes a plurality of segments, including segments S1, S2, and S3. The segments S1, S2, and S3 (and shared dimples shown in light and dark shading) may include the edge angle characteristics as shown in the following table.

TABLE 8

| Segment | Edge Angle |
|---|---|
| S1 | 12.0° |
| S2 | 14.25° |
| S3 | 13.75° |
| Shared dimples | 13.25° |

In some embodiments, the golf ball shown in FIG. 28 further includes a segment parameter that is equal across all of the segments. For example, the segments S1, S2, and S3 may all have the same segment volume rate, as shown in Table 9.

TABLE 9

| Segment | Segment Volume Rate |
|---|---|
| S1 | $4.30 \times 10^{-5}$ in$^3$ per degree |
| S2 | $4.30 \times 10^{-5}$ in$^3$ per degree |
| S3 | $4.30 \times 10^{-5}$ in$^3$ per degree |

The examples shown in FIGS. 27 and 28 include variations in parameters that are defined by segment, such as segment edge angle or segment chord depth. By varying these parameters within the boundaries of the individual sections, the dissimilar nature of the dimple pattern may be adjusted in order to further enhance performance and achieve improved aerodynamic symmetry. In order to determine values for parameters that are varied across segments, other parameters that are dependent on dimple variables may be set to be equal across segments. For example, a variation in edge angle may be determined based on a desired dimple segment volume for a given size of a dimple segment. For instance, the edge angle may be selected based on a segment volume rate selected for the golf ball. In another example, the surface coverage of the dimples in a section may be used to determine a segment parameter such as edge angle. For instance, segments that have a higher rate of surface coverage (more dimples packed into the space), may have higher or lower edge angles than other segments that have lower rates of surface coverage.

It should be understood that FIGS. 27 and 28 show only one hemisphere of the respective golf balls and that the other, unshown hemispheres may be identical or different than the hemispheres shown. In a disclosed embodiment, the hemispheres may share at least a common parameter, such as dimple count or dimple volume per hemisphere.

Further, golf balls of the present disclosure are not limited by a particular golf ball construction. The golf ball may have any type of core, such as solid, liquid, wound, and the like, and may be a one-piece, two-piece, or multilayer ball. Each layer of the golf ball may be constructed from any suitable thermoset or thermoplastic material known to those of ordinary skill in the art. When desirable, the cover may be coated with any number of layers, such as a base coat, top coat, paint, or any other desired coating.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a first hemisphere and a second hemisphere separated by an equator, each hemisphere comprising on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3, and wherein:

the pattern includes n number of dimple segments between the longitudinal lines, wherein a longitudinal angle between the side edges represents a size of each dimple segment;

within each hemisphere, the plurality of dimples consists of shared dimples that are intersected by the n longitudinal lines, and segment dimples that are each wholly within one of the n number of dimple segments;

the arrangement of the shared dimples on each of the longitudinal lines is identical;

the n number of dimple segments comprise at least two segments, S1 and S2, in each hemisphere that have a different longitudinal angle from each other;

the S1 segment has a first value for a segment parameter, wherein the first value is the same for a majority of the segment dimples in the S1 segment;

the S2 segment has a second value for the segment parameter, wherein the second value is the same for a majority of the segment dimples in the S2 segment;

the first value is different than the second value;

wherein the segment parameter is a segment edge angle; and wherein the first and second values satisfy at least one of the following:

(i) the first and second values for the segment edge angle differ by one degree or less, (ii) the first and second values for the segment edge angle are both between 11 degrees and 15 degrees.

2. The golf ball of claim 1, wherein the first and second values for the segment edge angle differ by half a degree or less.

3. The golf ball of claim 1, wherein the shared dimples have an edge angle corresponding to the segment edge angle of one of the adjacent segments.

4. The golf ball of claim 3, wherein the shared dimples all have the same edge angle.

5. The golf ball of claim 1, wherein the shared dimples each has an edge angle that differs from the segment edge angle of both its adjacent segments.

6. A golf ball having a first hemisphere and a second hemisphere separated by an equator, each hemisphere comprising on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3, and wherein:

the pattern includes n number of dimple segments between the longitudinal lines, wherein a longitudinal angle between the side edges represents a size of each dimple segment;

within each hemisphere, the plurality of dimples consists of shared dimples that are intersected by the n longitudinal lines, and segment dimples that are each wholly within one of the n number of dimple segments;

the arrangement of the shared dimples on each of the longitudinal lines is identical;

the n number of dimple segments comprise at least two segments, S1 and S2, in each hemisphere that have a different longitudinal angle from each other;

the S1 segment has a first value for a segment parameter, wherein the first value is the same for a majority of the segment dimples in the S1 segment;

the S2 segment has a second value for the segment parameter, wherein the second value is the same for a majority of the segment dimples in the S2 segment;

the first value is different than the second value;

wherein the segment parameter is a segment chord depth; and wherein the first and second values satisfy at least one of the following:

(i) the first and second values for the segment chord depth differ by 0.010 inches or less, (ii) the first and second values for the segment chord depths are both between 0.0025 inches and 0.0065 inches.

7. The golf ball of claim 6, wherein the first and second values for the segment chord depth differ by 0.005 inches or less.

8. The golf ball of claim 6, wherein the shared dimples have a chord depth corresponding to the segment chord depth of one of the adjacent segments.

9. The golf ball of claim 8, wherein the shared dimples all have the same chord depth.

10. The golf ball of claim 6, wherein the shared dimples each has a chord depth that differs from the segment chord depth of both its adjacent segments.

11. The golf ball of claim 1, wherein the n number of dimple segments further comprise a dimple segment S3 that has a different longitudinal angle than both dimple segments S1 and S2 and a different value for the segment parameter than the first and second values.

12. A golf ball having a first hemisphere and a second hemisphere separated by an equator, each hemisphere comprising on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3, and wherein:

the pattern includes n number of dimple segments between the longitudinal lines, wherein a longitudinal angle between the side edges represents a size of each dimple segment;

within each hemisphere, the plurality of dimples consists of shared dimples that are intersected by the n longitudinal lines, and segment dimples that are each wholly within one of the n number of dimple segments;

the arrangement of the shared dimples on each of the longitudinal lines is identical;

the n number of dimple segments comprise at least two of the segments, S1 and S2, in each hemisphere that have a different longitudinal angle;

the S1 segment has a first value for a first segment parameter and a second value for a second segment parameter, wherein the first value is the same for the majority of the segment dimples in the S1 segment, and wherein the second value is the same for the majority of the segment dimples in the S1 segment;

the S2 segment has a third value for the first segment parameter and a fourth value for the second segment parameter, wherein the third value is the same for the majority of the segment dimples in the S2 segment, and wherein the fourth value is the same for the majority of the segment dimples in the S2 segment;

the first value is different than the third value for the first segment parameter; and the second value is the same as the fourth value for the second segment parameter.

13. A golf ball having a first hemisphere and a second hemisphere separated by an equator, each hemisphere comprising on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3, and wherein:

the pattern includes n number of dimple segments between the longitudinal lines, wherein a longitudinal angle between the side edges represents a size of each dimple segment;

within each hemisphere, the plurality of dimples consists of shared dimples that are intersected by the n longitudinal lines, and segment dimples that are each wholly within one of the n number of dimple segments;

the arrangement of the shared dimples on each of the longitudinal lines is identical;

the n number of dimple segments comprise at least two segments, S1 and S2, in each hemisphere that have a different longitudinal angle from each other;

the S1 segment has a first value for a segment parameter, wherein the first value is the same for a majority of the segment dimples in the S1 segment;

the S2 segment has a second value for the segment parameter, wherein the second value is the same for a majority of the segment dimples in the S2 segment;

wherein the segment parameter is a segment edge angle or a segment chord depth;

the first value is different than the second value; and wherein the shared dimples satisfy at least one of the following:

(i) the shared dimples have an edge angle corresponding to the segment edge angle of one of the adjacent segments, (ii) the shared dimples have a chord depth corresponding to the segment chord depth of one of the adjacent segments.

14. A golf ball having a first hemisphere and a second hemisphere separated by an equator, each hemisphere comprising on the outer surface thereof a plurality of dimples arranged in a pattern, wherein the pattern is defined by an n-sided pyramid projected on a hemisphere, the side edges of the pyramid representing n longitudinal lines from pole to equator, wherein n≥3, and wherein:

the pattern includes n number of dimple segments between the longitudinal lines, wherein a longitudinal angle between the side edges represents a size of each dimple segment;

within each hemisphere, the plurality of dimples consists of shared dimples that are intersected by the n longitudinal lines, and segment dimples that are each wholly within one of the n number of dimple segments;

the arrangement of the shared dimples on each of the longitudinal lines is identical;

the n number of dimple segments comprise at least two segments, S1 and S2, in each hemisphere that have a different longitudinal angle from each other;

the S1 segment has a first value for a segment parameter, wherein the first value is the same for a majority of the segment dimples in the S1 segment;

the S2 segment has a second value for the segment parameter, wherein the second value is the same for a majority of the segment dimples in the S2 segment;

wherein the segment parameter is a segment edge angle or a segment chord depth;

the first value is different than the second value; and wherein the shared dimples satisfy at least one of the following:

(i) the shared dimples each has an edge angle that differs from the segment edge angle of both its adjacent segments, (ii) the shared dimples each has a chord depth that differs from the segment chord depth of both its adjacent segments.

* * * * *